US009845563B2

(12) United States Patent
Plata Amarillas et al.

(10) Patent No.: US 9,845,563 B2
(45) Date of Patent: Dec. 19, 2017

(54) WATER INLET SPRAYER FOR LOW PRESSURE (WILP)

(71) Applicant: MABE, S.A. DE C.V., Santiago de Queretaro, Queretaro (MX)

(72) Inventors: Santiago Alonso Plata Amarillas, Queretaro (MX); Ramon Merino Cervantes, Queretaro (MX)

(73) Assignee: MABE, S.A. DE C.V., Queretaro (MX)

( * ) Notice: Subject to any disclaimer, the term of this patent is extended or adjusted under 35 U.S.C. 154(b) by 598 days.

(21) Appl. No.: 14/321,191

(22) Filed: Jul. 1, 2014

(65) Prior Publication Data

US 2015/0067971 A1 Mar. 12, 2015

(30) Foreign Application Priority Data

Jul. 4, 2013 (MX) ..... MX/a/2013/007876

(51) Int. Cl.
*D06F 33/02* (2006.01)
*D06F 35/00* (2006.01)
(Continued)

(52) U.S. Cl.
CPC ..... *D06F 35/006* (2013.01); *D06F 33/02* (2013.01); *D06F 39/088* (2013.01); *D06F 23/04* (2013.01); *D06F 2202/085* (2013.01); *D06F 2202/10* (2013.01); *D06F 2202/12* (2013.01); *D06F 2204/06* (2013.01); *D06F 2204/10* (2013.01); *D06F 2220/00* (2013.01); *D06F 2232/06* (2013.01)

(58) Field of Classification Search
CPC ..... D06F 35/006; D06F 33/02; D06F 39/088; D06F 23/04; D06F 2202/085; D06F 2202/10; D06F 2202/12; D06F 2204/06; D06F 2204/10; D06F 2220/00; D06F 2232/06
USPC ..... 8/159
See application file for complete search history.

(56) References Cited

U.S. PATENT DOCUMENTS 4,815,665 A * 3/1989 Haruch ..... B01F 3/04049 239/432
4,986,093 A 1/1991 Pastryk et al.
(Continued)

FOREIGN PATENT DOCUMENTS

EP 0668389 8/1995

*Primary Examiner* — Michael Kornakov
*Assistant Examiner* — Tinsae Ayalew
(74) *Attorney, Agent, or Firm* — Terry M. Sanks, Esq.; Beusse Wolter Sanks & Maire, PLLC

(57) ABSTRACT

The present relates to washing machines comprising a tub within in which a basket is housed which rotates concentrically within this, driven by a motor mechanically coupled to an agitator and to the basket, a clutch which allows the coupling and uncoupling between basket and agitator, an electronic control which controls actuators by means of drivers, at least one admission valve, one level detector, one spray system, characterized by a wash method comprising: checking the water level, volume determination sequence which comprises determining in which the at least one admission valve remains open; an agitation sequence; a dehydrating sequence; a rinsing sequence which comprises using a determined number of rinsing blocks according to the amount of objects to be washed, introducing a determined amount of water into the basket by means of a nozzle.

16 Claims, 12 Drawing Sheets

(51) Int. Cl.
*D06F 39/08* (2006.01)
*D06F 23/04* (2006.01)

(56) References Cited

U.S. PATENT DOCUMENTS

| | | | | |
|---|---|---|---|---|
| 5,439,019 | A * | 8/1995 | Quandt | D06F 39/088 137/2 |
| 6,185,774 | B1 | 2/2001 | Tubman | |
| 2004/0261194 | A1* | 12/2004 | Price | C11D 3/0015 8/137 |
| 2008/0229517 | A1* | 9/2008 | Islas et al. | D06F 35/005 8/159 |
| 2010/0218563 | A1 | 9/2010 | Plata Amarillas et al. | |
| 2011/0099726 | A1* | 5/2011 | Plata Amarillas | D06L 1/20 8/137 |

* cited by examiner 17
37
18
18
δ

WATER INLET SPRAYER FOR LOW PRESSURE (WILP)

CROSS-REFERENCE TO RELATED APPLICATIONS

This application claims priority to Mexican Patent Application No. MX/a/2013/007876 filed Jul. 4, 2013, and incorporated herein by reference in its entirety.

BACKGROUND OF THE INVENTION

The present invention relates to a washing method, specifically a washing method for automatic washing machines with a basket which rotates concentrically within the tub, wherein the basket is driven by a motor. The washing method is carried out through sequences of checking the water level, load pre-detection, reshuffling agitation, load detection, pressure or liquid consumption determination in the supply network, normal agitation, agitation of the reshuffling of clothes, efficient rising and centrifuge (dehydration).

BRIEF DESCRIPTION OF PRIOR ART

The present invention lies in the field of household automatic washing machines, which have lately generated an increased concern regarding their water consumption as well as their energy consumption. This has led to designing various alternatives which allow for rational use of the vital liquid, as well as rational energy use. On the other hand, some types of washing machines, as for example front loading washing machines, upon using low amounts of water, in many cases have limited the performance of spot removal, lengthening the wash cycle, or resorting to using a means of increasing water temperature (process which in itself consumes high energy amounts), to fully achieve the chemical power of the detergents or other additives which are added to the water to create the wash liquor.

Said front loading or horizontal axis washing machines face the above described problems, should their water consumption be reduced in comparison to that of a top loading or vertical axis washing machine, they have lengthened cycles and the need of heating water, thereby increasing energy consumption. By not consisting of an agitator or propeller, large water currents which cross through the fabrics of the objects to be washed, are not created, and by not having scrubbers the "scrubbing" effect does not take place, so that its surfaces do not have strong friction with the surfaces of the objects to be washed. Additionally, said front loading or horizontal axis washing machines in turn require latched sleepers along the length of the cylinder or basket which aids in turning or mixing the clothes, thus creating friction among the clothes themselves as well as against the referred to sleepers and the inner surface of the basket. These significant differences on the one hand, cause the cycles of a front load or horizontal axis washing machine to be long, this being obvious given the low friction created between the objects to be washed, they are less mistreated, which makes the removal of spots and of dirt adhered to the fibers of the fabrics more difficult, knowing that there are low water and wash liquor currents which cross through said fabrics, in addition to low friction between the clothes themselves, thus resorting to the chemical action of the wash liquor, which in order to achieve said detergent action, requires heating the wash liquor in addition to lengthening the wash cycle to be able to obtain a good washing action on the textiles or objects to be washed.

On the other hand, top loading or vertical axis washing machines require great amounts of water in order for the propeller or agitator to be able to achieve large water currents, which in addition to the action of the scrubbers of the propeller or agitator, have friction on the surface or fabrics of the objects to be washed in addition to the chemical action of the detergents which aids in removing the spots stoutly adhered to the textile fibers. This system achieves shorter wash cycles with less energy, but with a higher water consumption cost; now then, the problem of water consumption in rinsing is also present, in which in top loading or vertical axis washing machines, typically the "deep rinse" technique is used, which implies filling the tub up to a predetermined level which allows the objects to be washed to "float" within the basket to later agitate the clothes or articles to be washed, and thereby diluting the detergent or other wash chemicals. This process is repeated at least once, which implies a high amount of water consumption, given that the wash tubs of conventional vertical axis washing machines can store up to 80 liters of water or more at one time. Thus, one of the objectives of present invention is to grant a wash method with efficient rinsing which saves water, in addition to energy, without damaging the clothing and with the same cleaning results as traditional washing.

Thus, a need for new washing technology exists which involves low water consumption in combination with low energy consumption, creates strong water currents which cause the wash liquor to cross between the fibers of the fabrics, vigorously scrubs the articles to be washed without causing damage, has efficient rinsing without consuming so much water or energy, which does not damage clothes, achieves cleaning results and clothing mistreatment results similar to those of a "deep rinse" or traditional rinse. These reasons lead to devising a top loading washing machine, which has a very particular agitator or propeller, which allows washing with a low water volume. Additionally, a wash and rinse method needs to be achieved which helps in energy conservation, in addition to an efficient wash cycle (wash, rinse and centrifuge), these being, among others, objectives of present invention.

Several efforts have been made with the end goal of decreasing water and energy consumption in household washing machines, such as is the case in document U.S. Pat. No. 4,986,093 by Pastryk et al, which describes a recirculation system which is set in a tank which adheres mechanically to the tub of the washer. Said tank receives the detergent or chemicals as well as a certain water volume, the tank serves for mixing the detergent with the chemicals so that these may be poured in a shower-like manner over the objects to be washed. This solution has the drawback of using huge amounts of water volume for the wash cycle, knowing that this is undertaken in the traditional manner, that is: the tub is filled up to a certain water level, where the objects to be washed remain completely immersed in the referred to liquid. This is followed by the agitation cycle, with the variation that prior to said agitation, the mixture or wash liquor contained in the tank is pumped towards a nozzle or shower spraying the objects to be washed with the referred to wash liquor. As can be seen, this method and arrangement of the tank do not contribute in a great measure to substantial savings in terms of water, nor to energy savings, but rather serves as a base for future developments, knowing that upon mixing water with detergents or chemicals, prior to these coming into contact with the objects to be washed, avoids an uncalled for chemical attack on the textiles and improves the mixture proportions for a more uniform wash liquor, in addition to this enhancing the performance of the detergents or wash chemicals.

A second example is document EP 0 668 389 by Kretchman et al, which discloses an improvement regarding the above cited document. Specifically, in the space which is found on the lower part of the basket and at the bottom of the tub, which has been taken advantage of for water storage, same which, once having a determined level of liquid in said area, detergent or wash chemicals are then added, mixing them in order to form the wash liquor. By means of a pump placed in a trough and hoses, the wash liquor is extracted to be sprayed by the upper part of the basket, while the bottom of the basket rotates with one or two degrees of freedom. In this manner once again, it can be seen that even though the small improvement of storing water at the bottom of the basket is of great help, the circular and undulating movement of the bottom of the basket, rather than helping, looks rather like an artifact found at a fairground ride. However, this does not represent an improvement regarding the performance of spot or dirt removal from the objects to be washed.

Document U.S. Pat. No. 6,185,774 by Tubman, describes a nozzle for spraying liquid into the inner part of the basket; said nozzle, just like other similar ones in prior art, has the misfortune of being a recirculation nozzle. That is, the nozzle is fed by a pump, or rather, in case that this could be fed from the outer water line or supply network, said supply network would require at the very least providing pressure of upwards of 6 PSI in order for the nozzle to function correctly. It is obvious that the referred to nozzle cannot function correctly at low pressure, that is, a pressure close to 3 PSI, which in some countries, such as Latin American ones, where the problem of great variations in water supply exists. So that the nozzle as well as the wash and rinse method of the present invention solves the above mentioned problem, as it was noted that in many Latin American countries a water tank or reservoir is placed on the roofs of houses, where the base of said water tank lies around 2.2 m in height measured from the cover of the tub (or tub cover) of the washer.

Another document is patent application MX/a/2009/002334, which is also published as US 2010/0218563 by Plata et al which describes a high efficiency wash method which overcomes the above mentioned problems. Said document has the peculiarity of storing water between the tub and the basket, to later be sprayed towards the articles to be washed by means of a pump arrangement, a hose and a sprayer. This system allows spraying the same amount of water on the objects to be washed, without depending on the pressure and volume of the supply line, which is a problem when attempting to add water to a tub, or it is required that the objects to be washed be sprayed, being obvious that at lower water pressures there is a lower volume and vice versa. Thus present invention proposes the removal of the pump arrangement, hose and sprayer, to replace it with a system which comprises, among others, a novel nozzle and hose which can operate at a wide range of liquid supply pressures without this impacting the performance of the washing or rinsing in the washing machine, thereby reducing costs in both parts as well as simplifying the manufacturing upon removing the pump, hose and sprayer.

Given this, in light of the problems described above, in addition to a higher consciousness on behalf of the consumer of household appliances for more efficient apparatuses, with greater benefits, lower costs, reliability, which can also withstand great variations in the water supply pressure or liquid supply, being able to function at both high and low pressures, and particularly, with a reduced water consumption, the present invention has been developed.

BRIEF DESCRIPTION OF THE INVENTION

The high efficiency wash and rinse method of present invention has the peculiarity of being able to adapt to different washing conditions imposed by the different washing habits of the users; knowing that upon coupling it with a novel nozzle capable of spraying water at both low and high pressures emanating from the water supply, prevents problems concerning filing or performance by guaranteeing uniform spraying of the water and liquid unto the objects to be washed, at a wide range of supply pressures.

The cycle of the preferred embodiment of the invention, begins when the user has introduced a determined amount of articles to be washed, optionally, a determined amount of wash additives, has selected the program to be used and has indicated the washing machine to start. This is followed by checking the water level, that is, the electronic control receives a signal from the pressure switch, which indicates the level or existence of water within the tub. The electronic control compares if the signal received corresponds to water level I or the measurement; should this be lower it continues with the load pre-detection sequence, but in the opposite case, it refers back the load determination sequence or in an alternative embodiment to the agitation sequence. Now then, the load pre-detection sequence indicates if an excess of clothing articles exists or a load which in a preferred embodiment reports greater than 7 Kg; if no such condition of clothing excess is detected, a clothing reshuffling sequence is begun, in which the basket is turned without water, this with the end goal of re-arranging the articles and objects to be washed within the referred to basket. This is followed by opening the water admission valve as well as those of detergent admission, so that the latter may be dragged to the bottom of the tub for the purpose of mixing it with the water being admitted, and in this manner the water is admitted until a pre-determined water level is reached in the tub, named a base level. When the pressure switch detects said level it sends a signal to the electronic control, and this in turn immediately initiates a timer which measures the time it takes to fill the tub between the referred to base level until the measurement level. When the pressure switch registers that the water level has reached the measurement level, and sends a signal to the electronic control where this latter stops the timer and registers the time value between the referred to base levels and measurement levels; this is followed by the electronic control de-energizing the water admission valve as well as the detergent admission one.

In the opposite case, if it detects an overload the electronic control omits the re-shuffling sequence as well as the one of measurement between levels, and directly proceeds to the load detection sequence. The referred to load detection sequence is undertaken to be able to determine in a more precise manner than the load pre-detection sequence, the amount of objects to be washed which are deposited within the basket. In this manner the appropriate water level can be determined, and in an alternative embodiment of the present invention, the centrifuge pattern as well as the rinsing blocks or rinsing profile with the end goal of conserving water. Once the amount of objects to be washed within the basket have been detected, in order to determine the wash level, the overload condition is re-checked; in such a case where such over-load condition exists, an agitation sequence is begun at a maximum load with a V level or water maximum to then undertake the dehydrating and rinsing steps. In the opposite case, if no such over-load condition exists, water is introduced up to the pre-determined level (level II or minimum, level III or medium, level IV or high), beginning the normal agitation sequence for a determined period of time, to then undergo the re-shuffling agitation sequence for another pre-determined amount of time. Afterwards, dehydration is undertaken to further rinse the objects to be washed deposited within the basket, which thanks to the information collected from the measurement level, the volume which can flow through the water supply line can be determined; this is of great help in order to be able to determine how much time the water admission valve of the spray nozzle should be left open, so that said nozzle sprays an amount of water onto the objects to be washed which allows for efficient rinsing, thus avoid using a deep rinsing, thus ending with this the complete wash and rinse cycle.

Thus, as can be seen, this novel washing and rinsing method is efficient in both its energy use as well as in its water consumption. Additionally, it comprises sequences which allow for continual functioning in case of excess loading of clothing articles, jamming of the objects to be washed, entanglement, overload, low or high pressure of the water supply line, or any other vicissitude which could occur when washing fabrics in a washing machine.

DETAILED DESCRIPTION OF THE INVENTION

Figure 1:
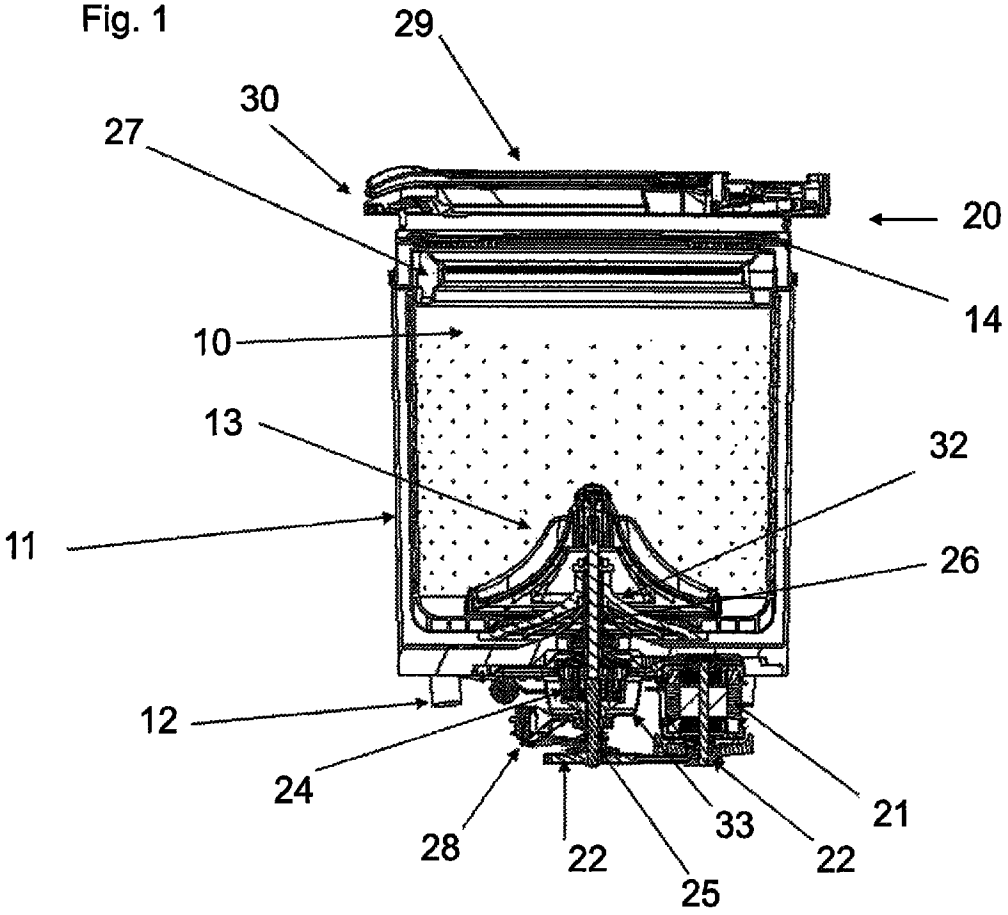
FIG. 1 is a cross cut of a washing machine.
Figure 2:
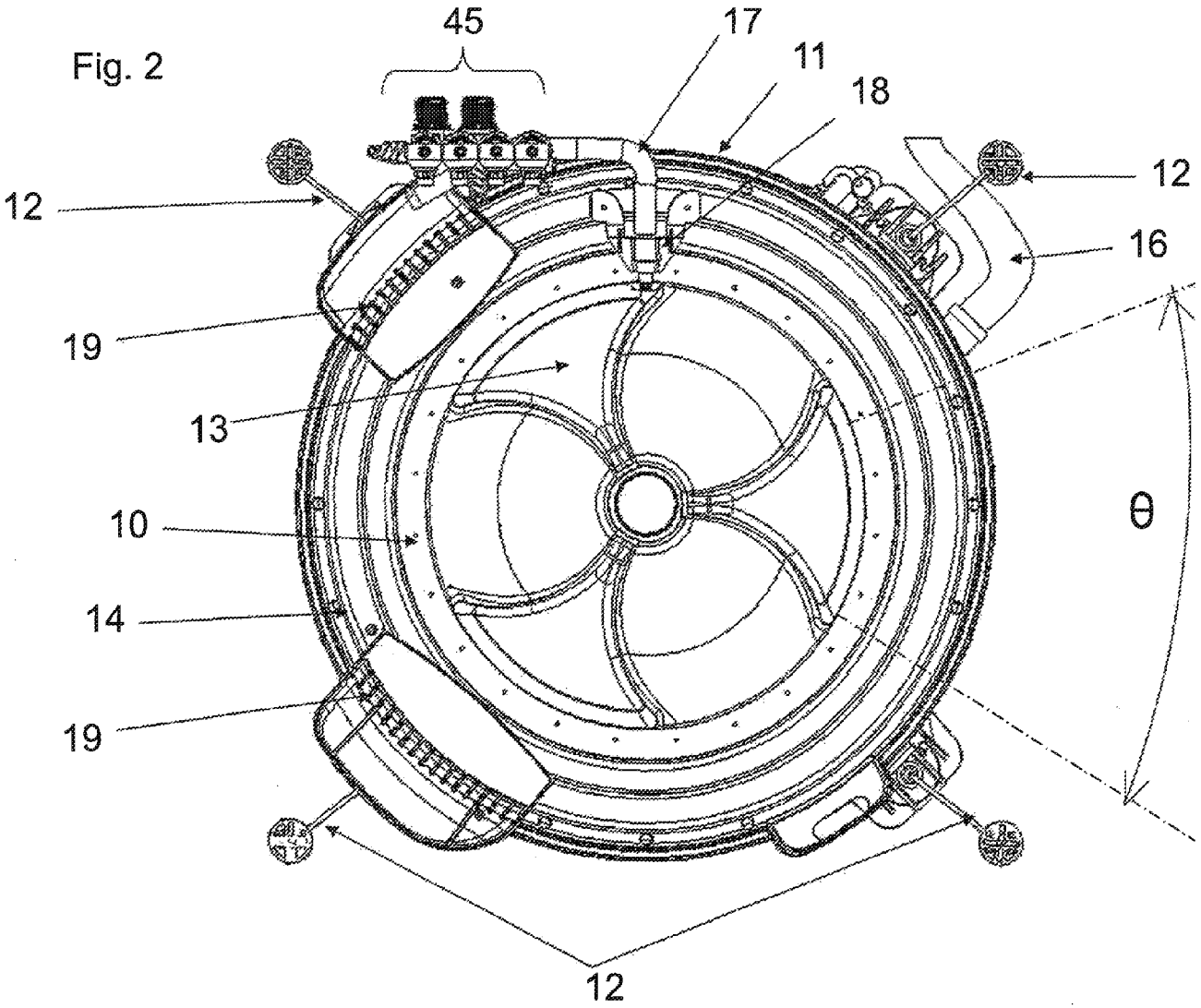
FIG. 2 is an upper view of a sub-washer, that is, a washing machine without cabinet.
Figure 3:
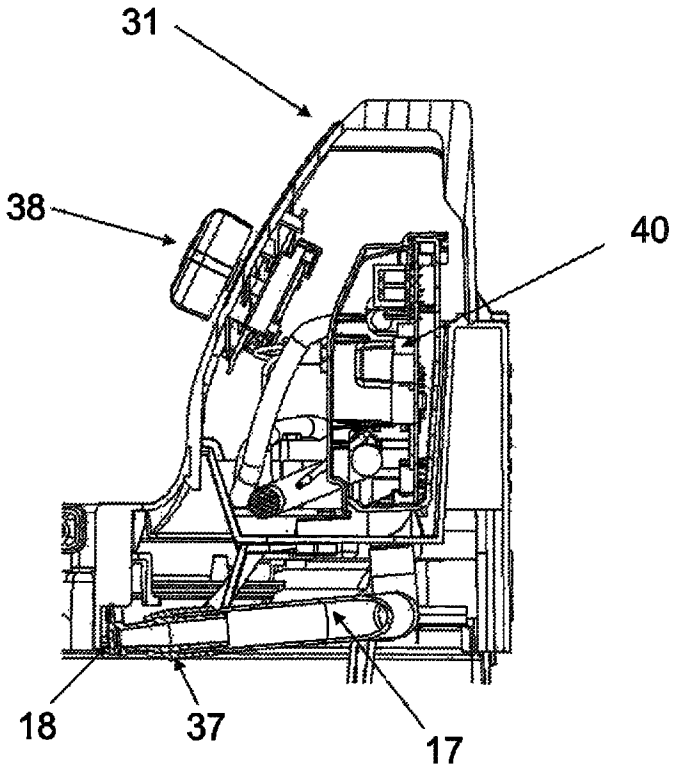
FIG. 3 is a cross cut of the crest of a washing machine.

The washing machine object of present invention, illustrated in FIGS. 1, 2 and 3 is a top loading or vertical axis type, so that it comprises a cabinet 39 from which four suspension bars 12 are fastened unto; said suspension bars 12 support the weight of the tub 11 along with the remainder of the accessories of the referred to cabinet, in addition to acting as a buffer for the vibrations which originate during the wash process. Thus, the tub 11 is hung from the referred to suspension bars 12 by means of some ears found in the lower part of the referred to tub 11. Over the referred to tub 11, the remainder of the peripheral equipment is mounted, such as the motor 21, optionally a planetary gear for reduction 24, which in an alternative embodiment of the present invention can be omitted, adjusting the relation of the pulleys 22, that is, the pulley 22 with the largest diameter will be adjusted over the inner shaft 25, which itself will receive energy emanating from the electric motor 21 thanks to the pulley arrangement 22 and the band. Optionally, the shaft 25 in its upper end is coupled to a planetary gear 24, with the end goal of decreasing angular velocity and thus obtain greater torque, the exit shaft of the planetary gear 24 is reintegrated into a shaft 25, which itself on its upper end has the agitator 13 seated. Optionally, the inner shaft 25 on its lower end has the pulley 22 with the greater diameter and on its upper end has the agitator 13 coupled unto it. The hollow shaft 26 houses in its inner part the inner shaft 25, said hollow shaft 26 is mechanically coupled to a clutch 28 which can make both shafts 25, 26 rotate together or in an independent manner; said hollow shaft 26 is mechanically coupled to the center of the basket or "hub" 32, so that when the shafts 25, 26 are clutched rotating together, the hollow shaft 26 will transmit energy to the basket 10 so that this turns along with the agitator 13.

Figure 4:
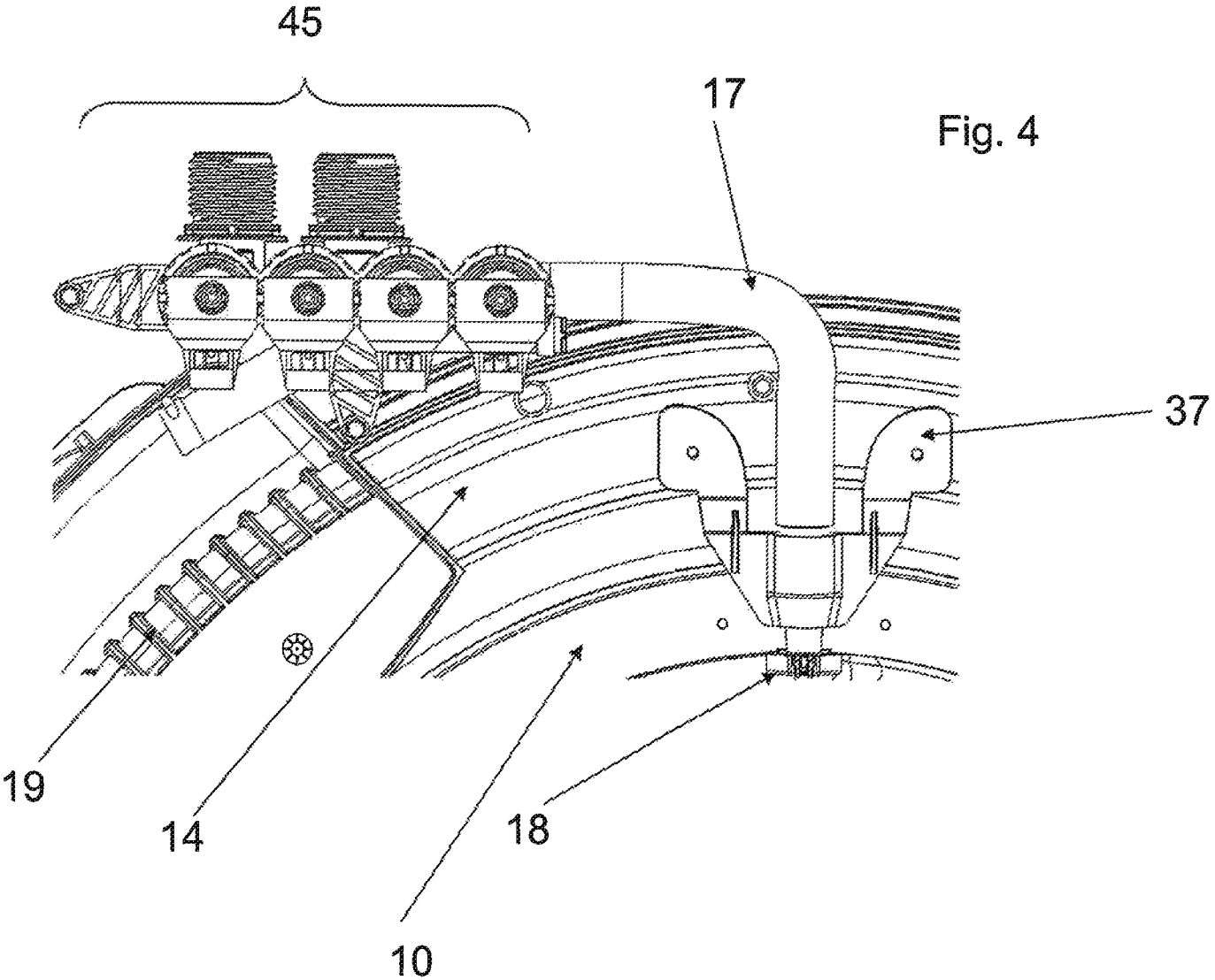
FIG. 4 is an upper detail of the valves, hose, nozzle and a segment of the basket and tub.
Figures 5A, 5B:
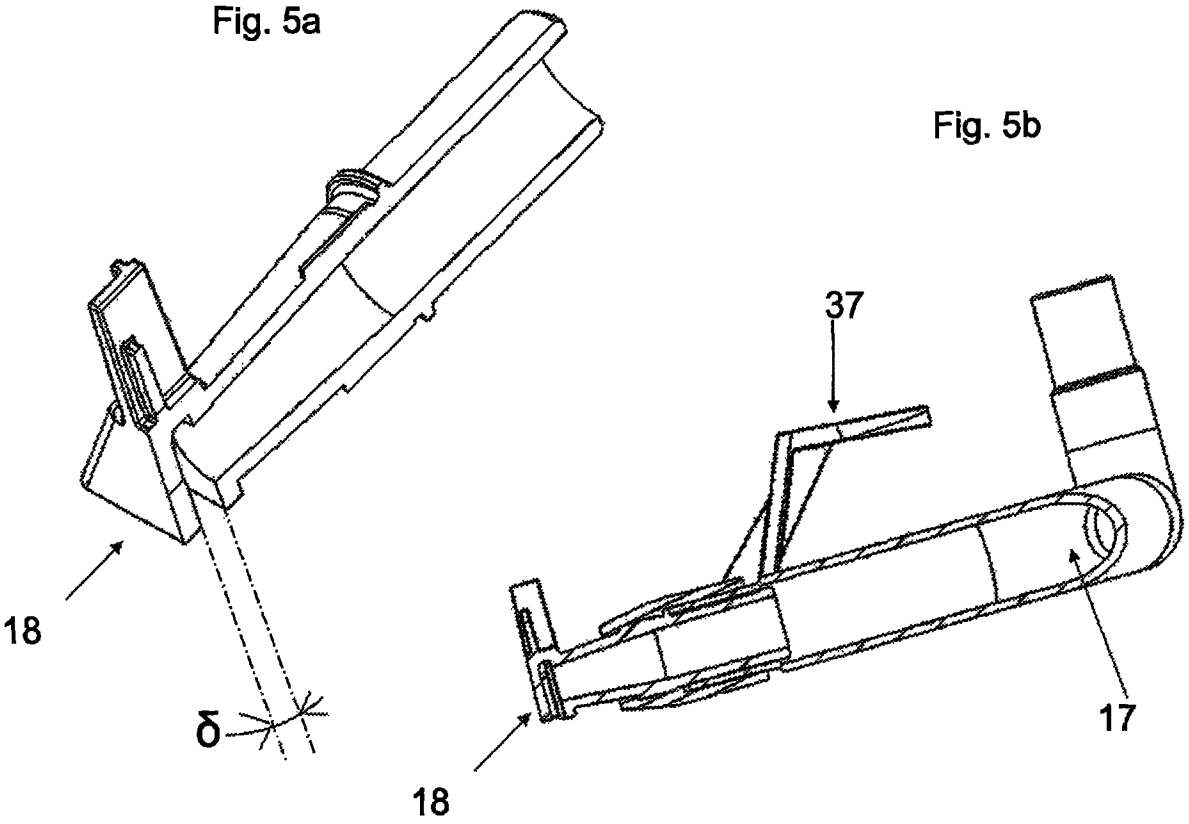
FIGS. 5*a* and 5*b* show different longitudinal cuts of the nozzle.
Figure 5C:
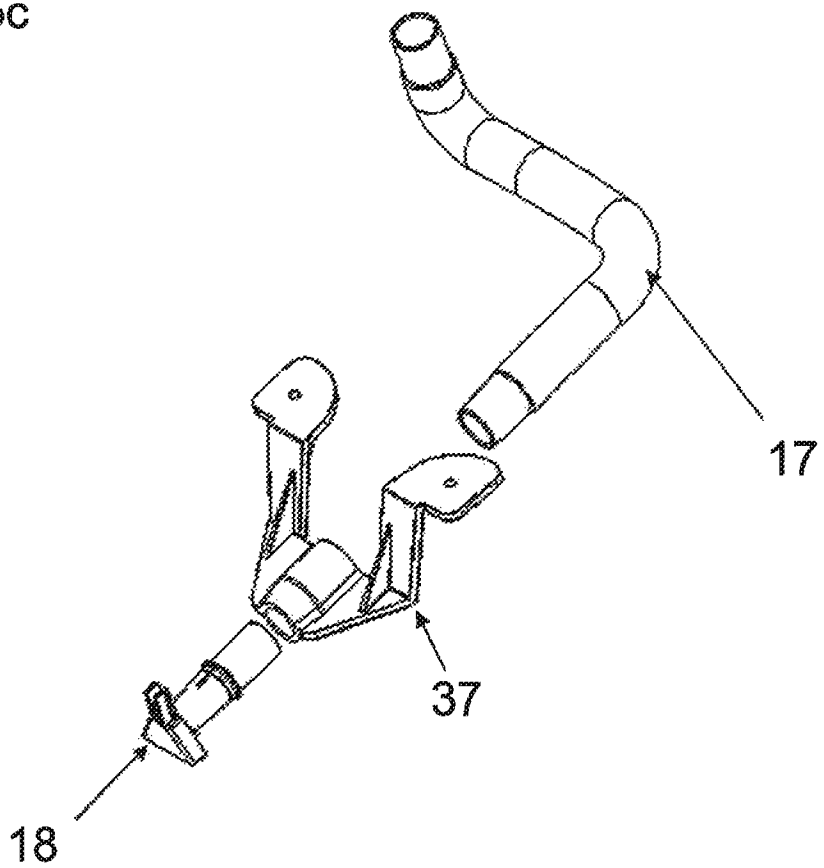
FIG. 5*c* shows an exploded isometric view of the spray nozzle, with its sections and its hose.
Figure 6A:
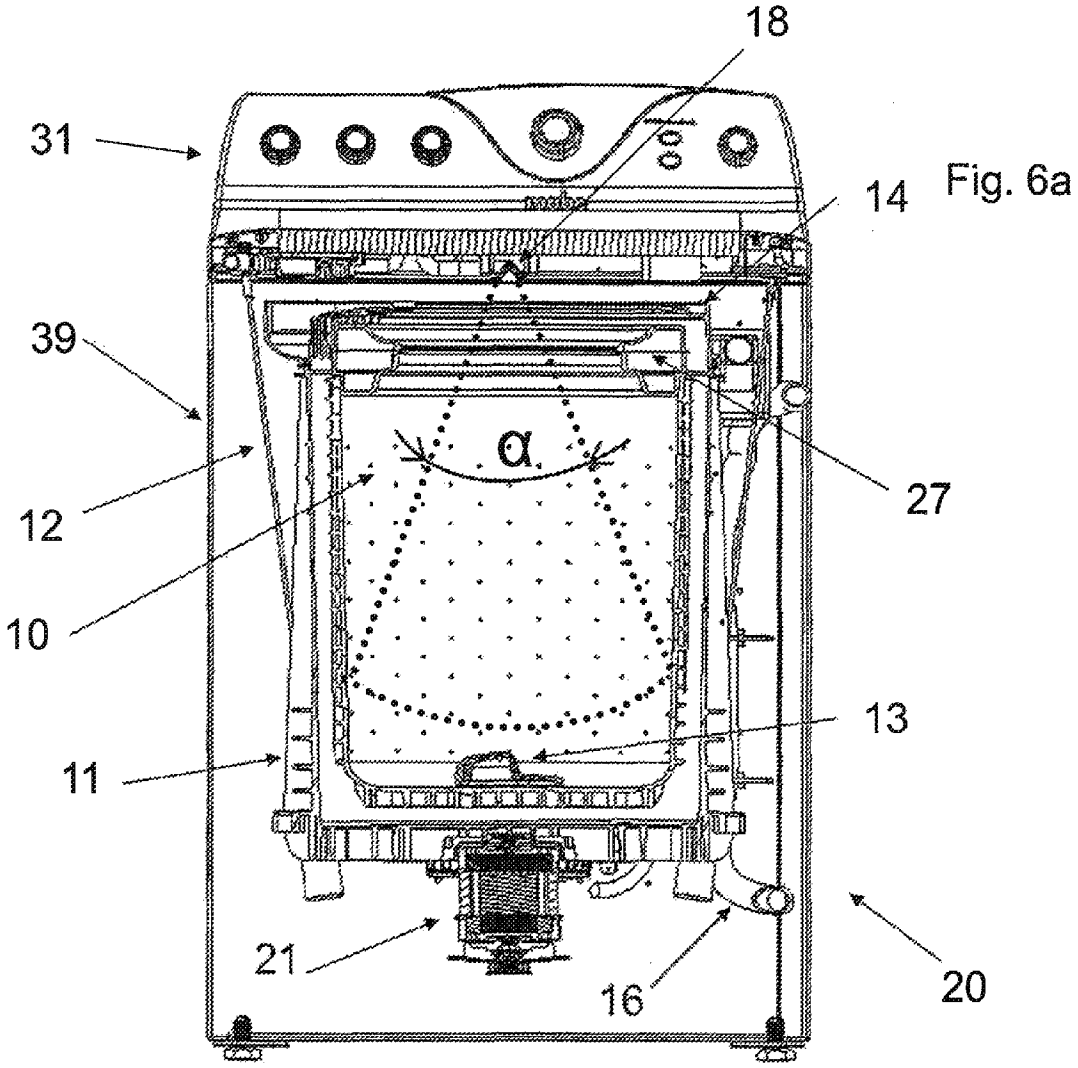
FIG. 6*a* shows a cross cut of a washing machine where the nozzle as well as the fan which form an $\alpha$ angle, can be seen.
Figure 6B:
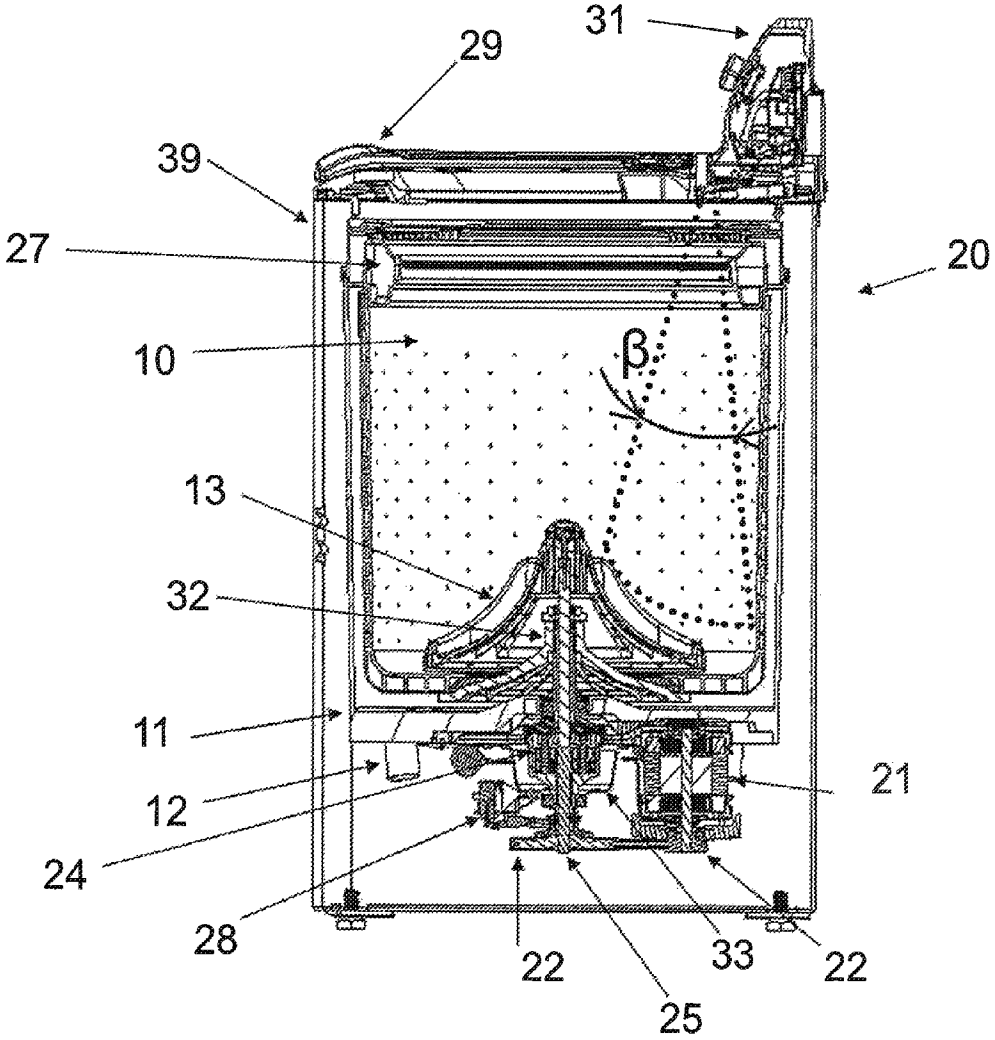
FIG. 6*b* shows a cross cut of a washing machine where the nozzle as well as the fan which form a $\beta$ angle, can be seen.

As can be seen in FIGS. 4*a*, 6*a*, 6*b* the cabinet 39 supports the suspension rods 12 on their upper part by means of corners set for such a purpose, which additionally aids in isolating the sub-washer from the surrounding environment. The upper part of the cabinet 39 also supports the cover or mask 30 which is grasped on its back part to the cabinet by means of screws. The referred to mask or cover 30 supports the assembly of the nozzle 18; and thus the support of the nozzle 37 is fastened unto the lower part of the cover 30 preferably by means of screws or another known fastening means. The referred to support 37 houses the nozzle 18 on its front part, with such luck that the end which has been introduced into the support 37 is coupled unto the first free end of the spray nozzle 12, thus the remaining end of the hose 17 is coupled to the body of the filling valves 45. It should be mentioned, that this nozzle assembly 18, 37, 17 can be found in any location under the referred to main cover 30, with the single restriction that it be found over the peripheral balance ring projection towards the lower surface of the main cover 30, the precise location shall depend on the design and engineering criteria for each particular case. In a preferred embodiment, the nozzle assembly 18 is found in close proximity of the back wall of the cabinet 39, such as illustrated in FIG. 4*a*. Said main cover 30 can also serve as support to a crest 31, where the electronic components such as the control 40, drivers (not shown), pressure switch etc. are housed, as well as the door or cover lid for the washer 29 through which the objects to be washed will be introduced.

As can be seen in FIGS. 5*a*, 5*b*, 5*c*, 5*d* the spray nozzle system 18, 37, as was already explained in the above lines, comprises a nozzle 18, which comprises three (3) sections, the back section is made up by a circular section duct both on its inner part as well as its outer part, named entrance duct. In a preferred embodiment, said entrance duct on its upper part is provided with a protruded ring over the outer surface of the referred to entrance duct, wherein said ring also serves as a bumper, as well as retainer, knowing that into a free end of the hose 17 the nozzle is introduced 18 through its back part, in such a way that the entrance duct remains housed within the hose 17 the ring serving as a bumper and seal to the crossing surface which is exposed to the hose 17. The nozzle 18 also comprises an intermediate section which is in a conical frustum shape in which the crossing section of the entrance duct is gradually reduced making it smaller towards the head. The above mentioned conical frustum section causes that the fluid circulating through it, gain speed upon the crossing section being reduced as well as helps maintain the flow or volume uniform. The remaining section named the head comprises a mouthpiece which is a cavity which receives the fluid flow emanating from the conical frustum section. The referred to mouthpiece cavity is delimited by a pair of lateral walls set at a δ angle, which oscillates between 35° degree and 100° degree its value being determined by design and engineering criteria. Similarly, the mouthpiece is also delimited by a deflector wall which is set in front of the exit of the conical frustum section, as well as a back wall, configured in such a way that the fluid flow emanating from the conical frustum section collides against the deflector wall, which allows the cavity of the mouthpiece to entirely fill with fluid, which results in a fluid fan with an opening angle α and with an inclination angle β, which allows spraying the objects found at the bottom of the basket 10 just under the nozzle 18. Said nozzle 18 can operate at a range of pressures which oscillate between 3 PSI up to 20 PSI. In an alternative embodiment of the present invention, the support 37 and the nozzle 18 can be formed in a single piece.

The basket 10 is crowned with a balance ring 27 which counteracts the unbalancing caused by the shuffling within the basket 10 if the objects to be washed. The tub itself has assembled on its upper end, a tub cover lid 14 which houses at least one grill 19.

FIG. 5 shows detail of the connection between the electronic control 40 with the various sensors or actuators which it controls, which allows correct functioning of the washing machine 20, by sending signals to the different actuators at the times determined by the method object of present invention, in this manner the electronic motor 21 is energized by means of a driver which receives signals from the electronic control 40. The referred to electronic control 40 sends a pulse of a certain length to the driver so that this, during the time that said pulse length takes place energizes the motor 21 in one direction. The same takes place to energize the motor 21 in the opposite direction, waiting a certain amount of determined time between slaps or pulse widths.

The high efficiency rinsing method which uses a low pressure nozzle, object of present invention is described below, knowing that the referred to high efficiency rinsing sequence 70, may be inserted or form part of a large variety of washing cycles, both high efficiency as well as conventional. In an embodiment of the present invention, the high efficiency rinsing method with low pressure nozzle object of present invention may be coupled unto almost any washing method of a top loading or vertical axis washing machine; an example can be seen in FIG. 7*a*, where the following considerations are taken: checking the water level once the operator or user decides to begin the complete wash cycle, so that, the electronic control reads the sign emitted by the pressure switch, which allows the electronic control 40 to determine the existence of the water level within the tub 11; should a level higher than water level I exist, in an alternative embodiment, the electronic control 40 takes the last data stored in its memory of the volume determination sequence 68. Now then, in the preferred embodiment the volume determination sequence 68 can be carried out prior to the agitation sequence 60, to later fill the tub 11 to the required water level. In an alternative embodiment this can be achieved by reading the knob positions, so that the electronic control 40 reads the position of the water level knob; having this information, the electronic control 40 determines the water level needing to be reached, so that it sends a signal or pulse to the driver of the filling valve 45, energizing the latter, in such a way that it allows the passage of water towards the bottom of the tub 11. The referred to signal or pulse is held until the pressure switch indicates to the electronic control 40 that the desired level has been reached, and then electronic control 40 interrupts said signal or pulse to the driver which then causes the filling valve 45 to de-energize and thus shut off; this is followed by the agitation cycles 60 being carried out. Upon the completion of these agitation cycles, the dehydrating sequence 69 is carried out and this is followed by the finishing rinsing sequence 70, which shall be described later.

Figure 7A:
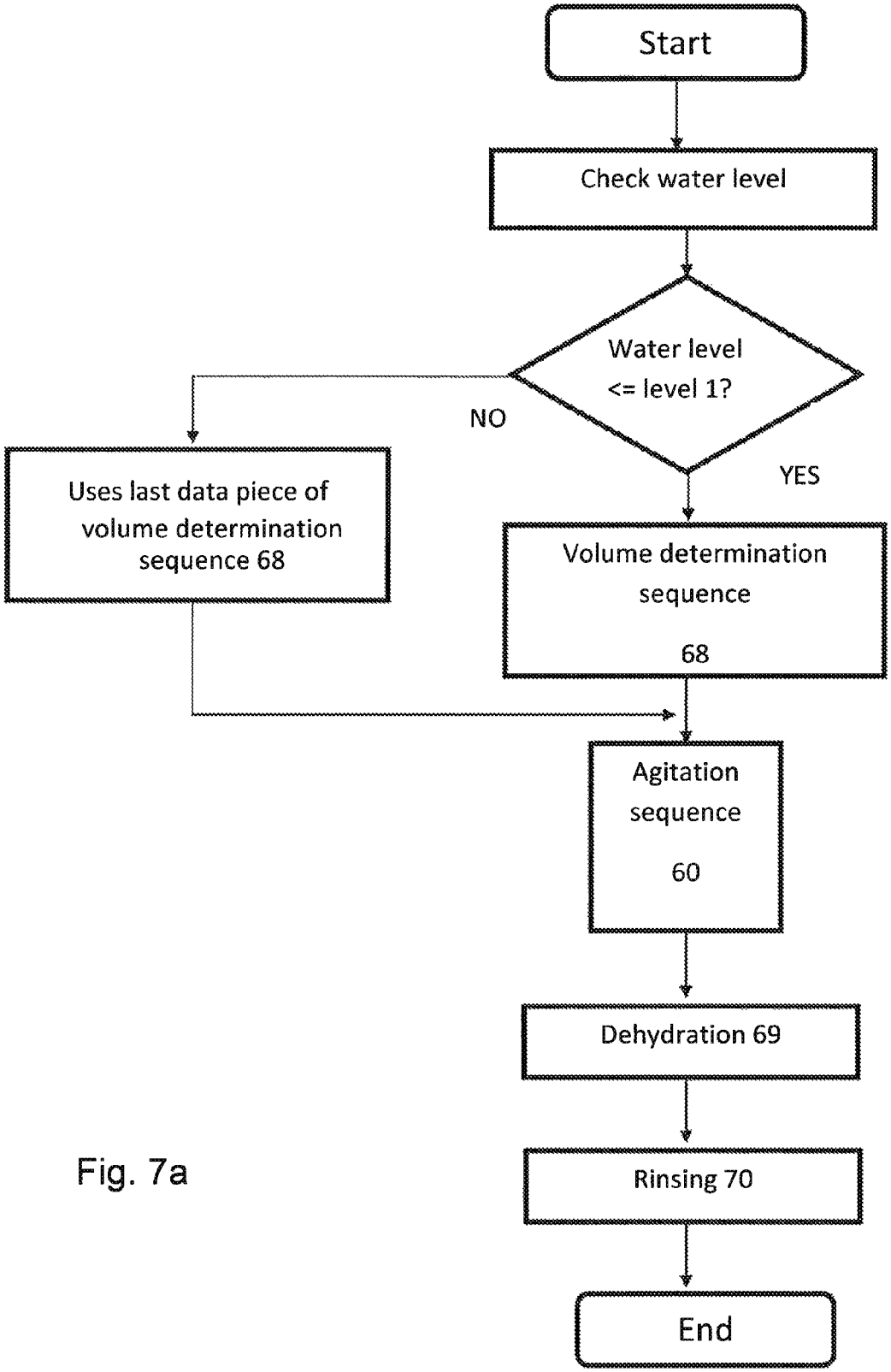
FIG. 7*a* is a flow diagram in an embodiment of the high efficiency wash method of the present invention.
Figure 7B:
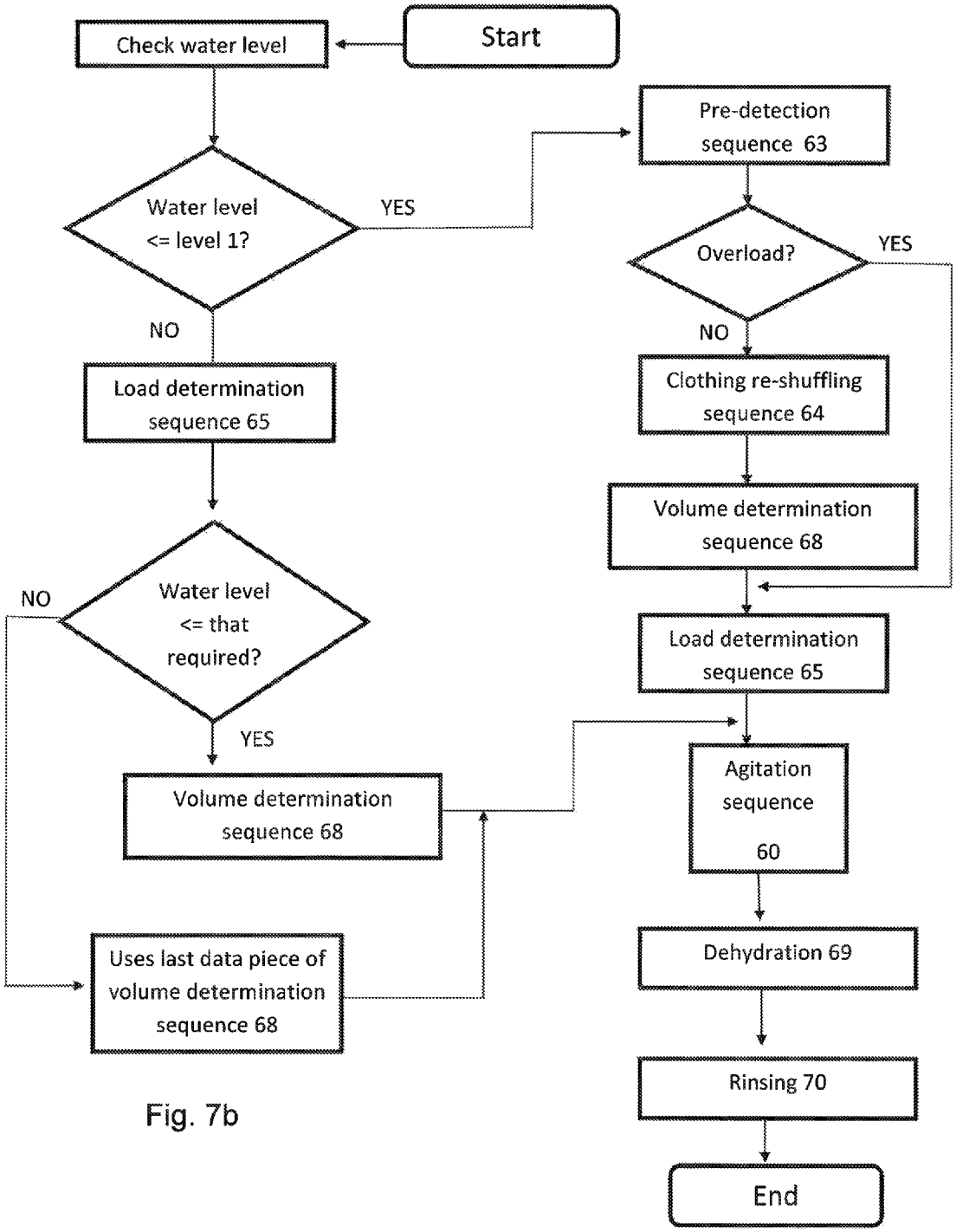
FIG. 7*b* is a flow diagram in an embodiment of the high efficiency wash method of the present invention.

In another alternative embodiment of the invention which is illustrated in FIG. 7*b*, the high efficiency rinsing method which uses a low pressure nozzle object of present invention referred to in FIG. 7*a*, begins when the user has introduced a determined amount of articles to be washed, adding in its case, a determined amount of wash additives, has selected the program to be used and has indicated the washing machine to begin. In this way, the electronic control 40 first checks if the signal which it obtained from the pressure switch indicates if the water level already contained in the tub 11 is greater than level I; if this is the case, the load determination sequence 65 is begun which will indicate the water level required for washing the objects to be washed which have been introduced into the basket 10. Thus at the end of said load determination sequence 65, the electronic control 40 will be able to compare the water level within the tub 11 as reported by the pressure switch and compare it versus the water level required by the agitation sequence 60 considering the volume of the objects to be washed introduced into the basket 10. If the water level present in the tub 11 is greater than the level required to carry out the agitation sequence 60, then the electronic control 40 uses the last data stored in its memory regarding the volume; this is followed by undertaking the agitation sequence 60. Now then, in case the water level contained in the tub 11 is lesser than that required to carry out the agitation sequence 60, then the electronic control 40 would undertake the volume determination sequence 68, by introducing the liquid into the tub 11 in order to reach the liquid level required to carry out the agitation sequence 60, then the electronic control 40 undertakes the volume determination sequence 68 by introducing liquid into the tub 11 to reach the liquid level required by the agitation sequence 60. Once the liquid level required by the agitation sequence 60 has been attained, and parallel to this, the volume determination sequence 68 obtaining the volume value has been carried out, the electronic control 40 initiates the agitation sequence 60. On the other hand, if the water level in the tub reported by the pressure switch is lesser than or equal to level I or base level, the electronic control begins the pre-detection sequence 63, which in turn indicates to the electronic control 40 whether an overload of articles to be washed exists within the basket 10 or not, for example, in an illustrative but not limitative manner, greater than 7 Kg. If no such condition of overload is detected, the electronic control 40 activates the clothing re-shuffling sequence 64, which in an alternative embodiment would be executed at several intervals in an intermittent manner as a spray sequence, same which shall be detailed further along; said spray sequence can also be used during the remainder of the wash cycle, or during the agitation sequence 60, such as can be a re-shuffling agitation sequence, with a high load or with a high density. This takes place with the end goal of being able to hydrate the objects to be washed above exposed or which are described above. Now then, in case of detecting an over-load, the electronic control 40 omits the re-shuffling agitation sequence 64 to then focus directly on the load determination sequence 65. The referred to load determination sequence 65 is undertaken to be able to determine with certain punctuality, as opposed to the load pre-detection sequence 63, the amount of clothes to be washed deposited within the basket 10, being able to then determine according to the amount of objects to be washed introduced into the basket 10, the water level required for the agitation sequence 60. Now then, after having undertaken the clothes re-shuffling agitation sequence 64, the electronic control initiates the volume determination sequence 68, which shall be detailed later. In this last sequence, the time it takes to fill two pre-determined levels within the tub with water is measured. With this piece of data, the volume which the water provides to the washing machine 20 can be known. This piece of data is particularly relevant to determine the water volume which is poured by means of the spray nozzle 18 unto the objects to be washed during the rinsing 70, which in a practical manner indicates the time during which the filling valves 45 remain open so that a determined amount of water passes through the nozzle 18. Now then, once the referred to volume determination sequence 68 has been finished, the electronic control 40 proceeds with the introduction of water until the predetermined level according to the load determination sequence 65, that is to say: level II or minimum, level III or medium, level IV or high (or in an alternative embodiment, one or more predetermined levels of liquid can be had), for the amount of objects to be washed which are inserted in the basket 10, in light of the electronic control 40 sending a signal to the driver of the filling valves 45, so that these may allow the ingress of water towards the tub 11. This happens up until the electronic control 40 receives the appropriate water level signal determined by the pressure switch (level II or minimum, level III or medium, level IV or high); upon such condition having been met, the signal to the driver of the filling valves 45 ceases, thus also ceasing the water supply towards the tub 11. Once having the appropriate water level, the electronic control 40 begins the normal agitation sequence 60 for a determined period of time which preferably varies between 5 to 30 minutes. Such time having lapsed, the electronic control 40 begins the agitation sequence 60, itself once carried out to its end, the electronic control 40 proceeds to initiate the dehydrating sequence 69, which allows for the removing of wash liquid or liquor contained in the tub 11, in addition to extracting wash liquid or liquor contained in the textiles or objects to be washed introduced into the basket 10. Once the objects to be washed have been dehydrated, that is that the dehydrating sequence 69 has lapsed, the electronic control 40 proceeds to initiate the novel rinsing sequence 70, objective of the present invention, which shall be detailed later. In this rinsing sequence 70 in which the wash liquor trapped in the fibers of the objects to be washed is removed with the least possible amount of water; knowing that typically a "deep rinsing" was used, that is, filling up the tub with water until a determined level, typically the same level used for the agitation sequence 60, to later "agitate" the objects to be washed within the basket 10 for a determined period of time. This was then followed by the extracting of wash liquor, in some cases the steps of filling, agitation, draining were repeated several times; this as is obvious, would create high water consumption, which the rinsing method object of present invention attempts to prevent in a novel manner. Now then, turning our attention to the wash cycle, once having finalized the rinsing sequence 70 the wash cycle is completed, at which time the electronic control 70 can sound an alarm alerting the operator or simply cease all activity.

Definitions

Arc—Angular distance which the agitator or propeller 13 is displaced, which is measured in degrees from its resting state until it once again acquires a resting position.

Objective arc—The expected angular distance which the agitator or propeller 13 is displaced while the motor 21 is energized.

Arc Measurement—Is carried out in the preferred embodiment of the present invention by means of a rotor position sensor preferably one of hall type 44 installed in the motor 21, which reports a determined number of pulses to the electronic control 40 each time the motor 21 is activated in each direction. The referred number of pulses is directly proportional to the length of the arc, so that a determined number of pulses can be referenced with a given arc length. In this manner, the electronic control 40 compares the pulses measured by the rotor position sensor by the swats or slaps versus a determined range of objective pulses.

Slap—The circular movement of the agitator or propeller 13 in a clockwise or anti-clockwise direction for a determined period of time; this is achieved when the clutch 28 is found in agitation mode. The electronic control 40 initiates the time counting with an inner timer and at the same time sends a signal to the motor driver 21 to energize the motor 21, thus driving the agitator or propeller 13 which shall describe a determined arc which is measured thanks to the rotor position sensor. Knowing that this latter sends a pulse train to the electronic control 40, which counts them, seeing as said electronic control 40 has a reference which is directly proportional between the number of counted pulses and the arc described by the agitator or propeller 13. Thus, when the electronic control 13 detects that the objective arc has been reached, the signal to the motor driver 21 is interrupted which stops the time counting of the inner timer, knowing that the agitator or propeller 13 to carry out its displacement and be able to comply with the trajectory of the objective arc, has a specified period of time; if the time lapses prior to the agitator or propeller 13 being able to comply with its angular displacement, the electronic control 40 will start counting a determined waiting time which varies between 0.01 second to 5 seconds, once the angular displacement condition or that of the passage of time has been met with. Said waiting time lapses before initiating a new slap in the direction opposite to the one immediately prior.

Strokes per Minute—Refers to the number of continuous slaps in both directions per minute and includes the wait time between slaps.

Agitation—The movement which is obtained over the objects to be washed through the action of the agitator or propeller 13 on the first immersed in the wash liquor.

Clog—According to the arc measurement if a condition is found where the arc of the slap is significantly lower than the objective agitation arc, the electronic control 40 assumes that a "clog" exists, which implies that an object to be washed has become stuck or has clogged the agitator or propeller 13 or that a high concentration of objects to be washed has formed in a reduced volume within the basket, thereby causing an undesirable high density of objects to be washed in an area within the basket 12.

Agitation Sequence 60

The normal agitation sequence comprises a pattern of slaps or arcs (agitator 13 turns in both clockwise and anti-clock wise directions), strokes per minute or number of times it turns each way for one minute and the agitation time.

The arc determination is a function of the liquid density of the clothes-washing, potential transmission and the motor 21 capacity in terms of the torque availability.

The objective arc for normal agitation oscillates between 180 to 720 degrees obtaining from 30 to 60 strokes per minute; said arc allows a correct friction between the scrubbers of the agitator 14 and the objects to be washed and also contributes to a better dispersion of the objects to be washed within the basket 12, achieving that these may have adequate movement of the clothing. A lesser arc would mean that an object to be washed has become stuck or that an unusual or non-desired accumulation of objects to be washed in the basket has formed, generating a high density of objects to be washed in a reduced volume within the basket 12, which causes the scrubbers of the agitator 13 to not be able come into contact with the objects to be washed, thereby generating a low friction among them and this leading to low dirt removal. These being, in addition to other motives, the reasons why the objective arc is being sensed at all times and be obtained from each stroke or slap, because as has been discussed previously in the above lines, an arc outside the range is not desirable, when it would then be necessary to take actions directed at a better distribution of the objects to be washed within the basket 12, as is the case in the high density agitation sequence or in the maximum load agitation sequence. Therefore, each stroke or slap is monitored, comparing its arc length versus the objective arc length. Said arc measurement is carried out in the preferred embodiment of the present invention by means of a rotor position sensor installed in the motor 21, which reports a determined number of pulses to the electronic control 40 each time the motor 21 is activated in a different direction. The referred to number of pulses is directly proportional to the length of the arc, so that a determined number of pulses can be referenced to a given arc length. Thus, the electronic control 40 compares the pulses measured by stroke or slap versus a determined range of objective pulses. If the median value lies within the range, the agitation and strokes or slaps continues in a conventional manner, but in the opposite case upon detecting a shorter arc than that of the normal agitation objective arc, the electronic control 40 considers that a clog is occurring, thus activating the high density agitation sequence, which shall be detailed further along. Said high density agitation sequence uses a rotor position sensor for a determined period of time to make a reduced arc, which in a preferred embodiment can return to the objective normal agitation arc described in the above lines. Once the agitation time has concluded which keeps running despite the various efforts determined by the proposed method for segregating clothing evenly within the basket 12.

Figure 8:
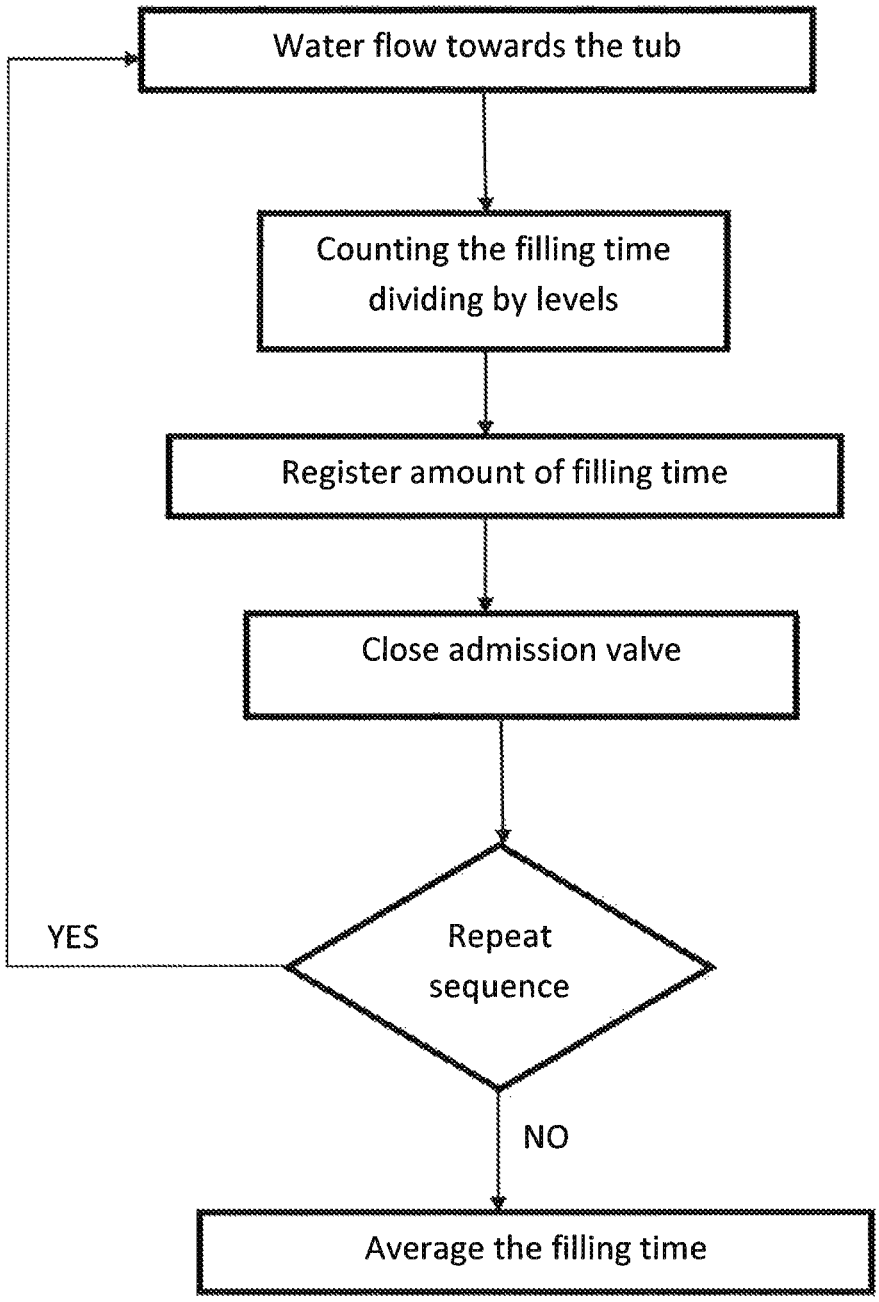
FIG. 8 is a flow diagram of an embodiment of the volume determination sequence.

Volume Determination Sequence 68—FIG. 8

This sequence is preferably carried out in the initial steps of the wash cycle, that is, prior to the agitation sequence 60, as an example in the wash cycle described in the present it has been set after the clothes re-shuffling sequence 64, even though in an alternative embodiment this can take place exactly at the beginning of the wash cycle.

Therefore, this begins when the electronic control 40 sends a signal to the driver of the filling valves so that they may allow the flow of liquid towards the tub, behind the basket 10, this with the end goal of not wetting through this procedure the objects to be washed contained in the referred basket 10. It should be noted that the liquid introduced into the tub 11 begins to accumulate at the bottom of this, which will cause the continual accumulation of liquid reaches level I or base 50 (in an alternative embodiment upon there being a volume of liquid already present in the tub 11 the pressure switch sends a signal to the electronic control 40 indicating the liquid level within the referred to tub 11). Upon this occurring, the pressure switch 41 sends a signal to the electronic control 40 and this, in turn, immediately initiates a timer which will count the time it takes to fill the tub 11 between the referred to level I or base level 50 until the measurement level 56 (in an alternative embodiment, when there is liquid present in the tub 11, the timer of the electronic control 40 counts the time it takes to fill between the volume or level of liquid already existent in the tub 11 and the level of liquid required for the agitation sequence 60, determining by means of the load determination sequence 65, or in another embodiment, by the level determined by the user by means of knobs set on the crest 31). The approximate volume between both levels oscillates between 3 liters to 15 liters; the precise volume will depend on design and engineering issues in each particular case. Now then, when the pressure switch registers that the water level has reached the measurement level (or in an alternative embodiment the liquid level required for the agitation sequence 60, determined by means of the load determination sequence 65 or in another embodiment by the level determined by the user by means of knobs set on the crest 31), sends a signal to the electronic control 40, where this immediately stops the timer, registering the time value between the referred to levels level I or base and the measurement, which is called filling time (in an alternative embodiment between the liquid level already present in the tub 11 detected by the pressure switch and the liquid level required for the agitation sequence 60, determined by means of the load determination sequence 65 or in another embodiment, by the level determined by the user by means of knobs set on the crest 31). This is followed by the electronic control de-energizing the driver of the filling valve, consequently resulting in the closing of the admission valve 45. It is worth mentioning at this point to clarify that the levels level I or base and measuring are used with the end goal of avoiding any error in taking time, knowing that if only base level or measurement were to be used, that is, that it operate under the presumption that the tub 11 is empty, that is: that the timer were to be started simultaneously with the first signal of the electronic control 40 to the driver of the admission valve, an error could occur in the calculation of the filling time, knowing that it is probable that the tub 11 could already contain liquid in its inner part, which could be erroneously accounted for.

In an alternative embodiment of the present volume determination sequence 68, happens once the load determination sequence 68 has concluded. In this way, the electronic control 40 already knows what level or volume of water is to be introduced into the tub 11, so that it shall be awaiting the signal from the pressure switch of the already predetermined water level (minimum level, medium level, high level or maximum level) by the referred to lead determination sequence 65. Once the electronic control 40 sends a signal to the driver of the filling valve so that this in turn energizes the filling valve 45, the electronic control 40 simultaneously energizes the timer once again, while the fluid or water begins to be guided towards the tub 11, the water accumulates until reaching the minimum level, which causes the pressure switch to send a signal to the electronic control 40 which registers the filling time it took the filling from the level immediately prior to the one recently reached (that is, level I or base level to minimum level). It also compares with the level which is to be reached to begin the normal agitation sequence 60. Thus the electronic control 40 by means of the timer and the pressure switch registers the partial filling times it takes the water volume stored in the tub 11 to reach the pre-determined liquid levels, with such luck that the compiled data are averaged to obtain a final filling time data, which will be stored to be used in the rinsing sequence or step 70.

In a preferred embodiment of the present volume determination sequence 68, the electronic control 40 sends a signal to the driver of the chemicals dispenser, so that this in turn can energize the valve which allows the flow of water towards the inner part of the referred to dispenser 34, this with the end goal of dragging the detergent or other wash chemicals, which are guided to the bottom of the tub 11. In this same manner, when the water volume accumulated reaches measurement level and the pressure switch sends a signal to the electronic control 40, this stops the timer, registers the value of filling time and additionally interrupts the signal to the driver of the chemical dispenser, having as a consequence the de-energizing of the chemical dispenser valve; and thus ceases the water supply towards the referred to chemical dispenser.

Load Pre-Detection Sequence 63

This sequence is based in a measurement of the inertia which the basket 10 consists of. Upon the basket 10 being empty, its inertia is lesser than that registered when it has the load of the objects to be washed. The load pre-detection sequence 63 helps to determine if an over-load condition exists, that is, for example, in an illustrative but not determinative manner, when the user has placed more than 7 Kg of load or objects to be washed within the basket, and this condition is detected, the electronic control 40 does not use the load re-shuffling sequence which will be further detailed later, knowing that the high density of the objects to be washed within the basket 10, in the case of over-load detection, does not allow that the objects to be washed become accumulated (or that they become clumped) in exact or specific places within the basket 10, so that it results unnecessary and counterproductive to use the clothes re-shuffling sequence, directly proceeding unto the agitation sequence.

Now then, the sensing of overload is undertaken once the user has introduced the objects to be washed into the basket 10. Given that the clutch 28 is found in centrifuge mode, the user, upon pushing the "start" button, sends a signal to the electronic control 40 which recovers in a first instance a signal from the pressure switch to be able to determine the existence of an adequate amount of wash liquor or water within the tub 11. If the level of wash liquor or water is greater than level I, the electronic control does not carry out the pre-sensing sequence, proceeding directly to the agitation sequence. In the opposite case, if there is no wash liquor or water within the tub 11, or if this is at a level equal to or lower than level I, the electronic control 40 sends a pulse at 100 ms to 700 ms to the driver of the motor 21, so that this energizes the motor 21, and keeping in mind that the clutch is in dehydrating mode, which will cause both the basket 10 as well as the agitator or propeller 13 to turn in unison, given that the inner shaft 25 is clutched with the hollow shaft 26. In this way then both, the basket 10 as well as the agitator or propeller 13 turn in one direction for a determined period of time, this time comprises two components, the first being the duration of the pulse emitted by the electronic control 40 to the driver of the motor 21, and the second component is determined by inertia, because it is the time which it takes the basket 10 to reach to its resting position, in this manner, describing the arc length which directly depends on this second component. In this way, the rotor position sensor of the motor 21 sends a pulse along the determined arc length. The referred to pulses emitted by the rotor position sensor are sent to the electronic control 40 which counts them. In this manner, a determined number of pulses can be related to an arc length or to a deceleration time of the basket 10. In this fashion, the pulses which the rotor position sensor set on the motor 21 emits, counted from the point at which the motor 21 was de-energized, for a determined period of time (preferably approximately 15 milliseconds) allow determining an overloaded condition. It is such, that the number of pulses emanating from the rotor position sensor counted by the electronic control 40 for a determined period of time are stored in the memory of the referred to electronic control 40, to later be compared to a determined value, which, if it is equal to or greater, will indicate an overload condition, a condition which is also stored in the memory of the multiply cited electronic control 40. In this way, once the basket is yet again in its resting state, the electronic control once again emits a pulse in the opposite direction than the pulse emitted immediately prior to the driver of the motor 21. This last one will cause the basket 10 and the agitator or propeller 13 to turn in the opposite direction than the pulse emitted immediately prior for a determined period of time, which in a similar manner to the prior pulse emitted by the electronic control 40 to the driver of the motor 21 will comprises two components: the first being the time or pulse width which maintains the motor 21 energized, and the second being the deceleration time. Once again the number of pulses emitted by the rotor position sensor towards the electronic control 40 is newly measured for a determined period of time which preferably oscillates between 300 and 990 milliseconds. Similarly, once again the number of pulses counted by the electronic control 40 emanating from the rotor position sensor for a determined period of time is compared to a predetermined value. Then, if it is equal to or greater, will indicate an overload condition, and these values are then stored in the memory of the electronic control 40. Then, if the result of the pulse emitted by the electronic control 40 to the driver of the motor 21 or the actuator immediately prior indicates an overload condition, the electronic control 40 will consider that such an overload condition actually does exist and will act accordingly, omitting the re-shuffling of clothing sequence 64 to proceed directly to the load sensing sequence 65; if the opposite case is true, the electronic control 40 initiates the clothing re-shuffling sequence 64.

Clothing Re-Shuffling Sequence 64

This sequence serves to uniformly distribute the objects to be washed within the basket 10, avoiding concentrations of the objects to be washed in a small space, which causes high densities of the objects to be washed or clumping of the objects to be washed within the basket 10, not allowing for efficient contact with the agitator or propeller 13, which leads to an undesirable movement of the objects to be washed within the basket by not being able to follow the flow of the wash liquor generated by the agitator or propeller 13. Consequently, the currents of wash liquor which cross through the fibers of the objects to be washed are not sufficiently strong, and consequently reducing their wash capacity. Given these reasons, in addition to others, an efficient shuffling of clothing articles within the basket 10 is carried out prior to the agitation sequence, with the end goal of achieving a good wash of the objects to be washed taking into consideration the use of a moderate or a low amount of water.

Thus, after having carried out the load pre-sensing sequence and having determined from the electronic control that an overload condition does not exist, with the basket 10 being in resting position, the electronic control 40 sends a pulse between 8 to 12 seconds long to the driver of the filling valve or water admission 45 to allow the flow of fresh water to the inner part of the tub 11, which, in an alternative embodiment of the invention, can be hydraulically connected to the chemical dispenser, thereby also sending the electronic control 40 a pulse for the same amount of time to the driver 74 of the referred to chemical dispenser. In yet another alternative embodiment of the invention, the electronic control 40 sends a pulse for a determined period of time to the driver of the liquid bleach admission valve, so that it allows the admission of this liquid in case the user has deposited a certain volume of liquid bleach in the corresponding chemical dispenser. So that, upon opening the liquid bleach admission valve, a volume of water is admitted, which is guided through the chemical dispenser dragging with it the bleach volume which was deposited in the cited chemical dispenser, which guides the wash liquor in order to, in a waterfall style manner, fall through the buffer over the grill 19, which allows the passage of the wash liquor between the tub 11 and the basket 10, avoiding contact with the objects to be washed, then depositing the wash liquor at the bottom of the basket, which allows for uniform mixture of the chemicals with the water without directly pouring the chemicals over the objects to be washed which could cause undesired splotches given the chemical attack on the surface of the objects to be washed as a consequence of poor dilution and therefore of the chemicals with the water.

Once the commented pulse width has lapsed, the electronic control sends a pulse between 2 to 20 seconds long to the driver of the pump 15, which allows the latter to supply wash liquor during the width of the referred to pulse towards the spray deflector 18, spraying the objects to be washed which are found within the action cone of the cited spray defector 18 with wash liquor. The duration of the commented pulse having lapsed, the steps are repeated for a determined amount of time which oscillates between 30 to 60 seconds, or at least for one revolution of the basket 10, with such luck that the objects to be washed within the basket 10 are completely soaked with the wash liquor which had accumulated at the bottom of the tub 11. This is followed by once having transferred all or a great majority of the water volume which had accumulated at the bottom of the tub 11 towards the objects to be washed, the electronic control 40 sends a pulse which oscillates between 5 to 15 seconds to the driver of the motor 21, remembering that the clutch 28 is found in dehydrated mode. This allows the basket 10 to rotate the objects to be washed contained within the basket 10, where upon rotating at a certain speed for a determined amount of time, the wash liquor is extracted from the textiles, and is collected at the bottom of the tub 11. When the basket is rotating, the rotor position sensor sends a pulse train to the electronic control 40, and this in turn determines at which speed the motor is turning thanks to its internal logic. Thus when the motor reaches a speed which oscillates between 90 to 150 rpm, the electronic control 40 de-energizes the driver of the motor 21 causing immediate deceleration to the basket 10 until the basket recovers its resting state, the electronic control 40 having detected this condition, thanks to the absence of pulses from the rotor position sensor 44; in an alternative embodiment of the invention the steps of this sequence are repeated at least one time.

Load Determination Sequence 65

The purpose of this sequence is to determine by means of a particular agitation pattern the amount and type of objects to be washed, so that as a function of the resistance which said load opposes the movement of the agitator or propeller 13, the corresponding water levels are defined for the agitation during the washing phase, the centrifuge pattern and the number of rinsing blocks.

This sequence operates in two modes; the first is that when the electronic control 40 does not have an overload registry the second when the electronic control 40 does have an overload registry. Thus, in the first case, when no overload registry exists, the electronic control 40 in some manner has to arrive at a qualitative data regarding the amount of objects to be washed within the basket 10, to be able to determine the water level to be used during the agitation sequence, the number of rinsing blocks, as well as the centrifuge ramp profile in the dehydrating sequence. In this manner, the present sequence was developed without using more sensors than the rotor position sensor found in the motor 21. Thus, the sequence in comment is initiated when the electronic control 40 checks on the existence of an overload; in case such condition is not found (first mode) a signal is sent to the driver of the filling valve 45, so that these allow the water flow towards the tub 11 to be stored at the bottom of it. This condition persists until the pressure switch sends a signal to the electronic control that the minimum level or level II has been reached. Keeping in mind that the clutch 28 is in agitation mode, when said minimum level or level II has been reached, the electronic control 40 ceases the signal to the driver of the filling valve 45, now sending a signal to the driver of the motor 21. In a simultaneous manner, the electronic control 40 counts the pulses sent by the rotor position sensor carrying out the arc measurement, with an objective arc being between 180 to 720 degrees at a frequency of 20 to 60 strokes per minute until a certain number of determined strokes or slaps have been counted, as for example, between 10 and 40 strokes or for a determined period of time, which preferably oscillates between 30 to 50 seconds. Once this time has lapsed, the agitation is continued with an objective arc between 180 to 720 degrees, counting a certain number of slaps which preferably can oscillate between 10 and 40, or for a second period of time which can preferably last from between 20 to 40 seconds. It is here, in this second period of time, where after each slap or rotation is undertaken which preferably oscillates between 180 to 720 degrees, where the electronic control 40, upon detecting that the rotation angle in comment has been reached and has interrupted the signal to the driver of the motor 21, it begins to count the pulses sent by the rotor position sensor until the agitator or driver 13 reach their resting position, which causes the pulse train which the rotor position sensor sends to the electronic control 40 to be interrupted. Thus the electronic control 40, for each slap or angular route, registers the number of pulses which the rotor position sensor has sent, the motor 21 being de-energized, said data is stored in the memory of the referred to electronic control 40, along with the slap or angular route data immediately following in the opposite direction. This couple of data pieces are averaged and stored in the memory, with such luck that each slap or angular routing is averaged with the one immediately following, erasing the data of the immediately prior pair of slaps. This occurs until the second time lapse is finished. When this condition takes effect, this last averaged data which remains in the memory of the electronic control 40 is compared against predetermined values, which indicate the water level to be used. This is followed by the electronic control 40 sending a signal to the driver of the filling valve 45 until the water level determined for the load of the objects to be washed has been reached, thanks to the signals which the pressure switch sends the electronic control 40.

In the second mode, if the detected overload condition is indeed confirmed in the pre-sensing sequence, the electronic control 40 initiates the maximum load agitation sequence 62.

Spray Sequence 66

This sequence functions as the alternative embodiment for the wash method, aspect of present invention. The sequence is carried out in the agitation sequences 60 or in the rinsing sequences 70 in the following manner: taking into account that within the tub 11 a determined volume of wash liquor is found, this being detected by the pressure switch which sends a signal to the electronic control 40, should said level of wash liquor or volume of wash liquor be greater than or equal to the minimum water level 51 or level II, the electronic control 40 sends a pulse for a determined period of time which can oscillate between 30 seconds to 120 seconds to the driver of the filling valve 45 so that this will allow the free fluid passage towards the spray nozzle 18 by means of the spray hose 17, with which the exposed objects to be washed within the basket 10 are wetted or hydrated; this is followed by the electronic control 40 counting a determined waiting time which can oscillate between 1 to 2 minutes; this time having lapsed, the sequence is repeated sending once again a pulse for a same period of time to the driver of the spray pump, repeating this process for a determined time which oscillates between 30 seconds to 5 minutes.

In an alternative embodiment the referred to pulse which the electronic control 40 emits to the driver of the filling valve 45 it is calculated that according to the data collected from the volume determination sequence 68 in a manner which is similar to that of how the amount of water to be introduced into the rinsing blocks is calculated (see table 1) which shall be discussed in detail in the rinsing sequence 70. Thus having determined the water volume to be introduced into the basket, this sequence can be activated by the electronic control in an intermittent manner while the filling valves 45 are energized or during the load determination sequences 65, normal agitation sequence 60, or in any other particular sequence of the wash cycle in question.

Dehydration 69

The dehydrating step aids in the extraction of wash liquor. This sequence is carried out making the basket 10 turn, which thanks to centrifuge force, the wash liquor gathers on the wall with holes of the basket 10 to be evacuated by means of said holes towards the tub 11, where the wash liquor extracted is pumped towards the outside by means of the drainage pump which has a draining hose 16 connected at its exit. Then the electronic control 40 sends a pulse for a determined period of time varying between 2 to 8 minutes, to the driver 75 of the drainage pump; at the same time it also sends a signal to the driver of the clutch 28 so that it carries out the change from agitation mode to dehydration mode. In an alternative embodiment of the present invention the clutch can be a flowing clutch which in the presence of or in the absence of the wash liquor can engage or disengage the shafts 25 and 26, being obvious that said floating clutch would not use an actuator so that the electronic control will not be able to send any signal to activate it or to de-activate it. Then, the clutch being in dehydrated mode, the electronic control also sends a pulse for a determined period of time to the driver so that this energizes the motor 21, thus turning the basket 10 in unison with the agitator or propeller 13. The referred to pulse sent by the electronic control 40 can vary depending on the type of centrifuge desired. In this manner, in an alternative embodiment a pulse train with varied widths can be sent with the end goal of accelerating and decelerating the basket 10 to extract less water upon decelerating the basket giving the drain pump 35 time by extracting the wash liquor accumulated at the bottom of the tub 11, in addition to avoiding problems concerning the accumulation of foam between the tub 11 and the basket 10, which causes the phenomena known as "sudsing".

In an alternative embodiment of the present invention, the motor 21 can be energized in an intermittent manner allowing deceleration of the basket 10 allowing time so that the pump can empty the wash liquor accumulated at the bottom of the tub, with the end purpose of avoiding "sudsing", which is created thanks to the water accumulation at the bottom of the tub in such a way that upon the wash liquor coming into contact with the basket while it turns, the friction generates high surface tension which the wash liquor has, in addition to the speed with which said wash liquor is projected unto the circular wall of the tub 11, creating a high foam concentration between the ring space of the basket and the tub, which could cause the basket 10 to stop even when the motor 21 is energized. Any other prevention method or handling of "sudsing" available in the state of the art can be present.

Figure 9:
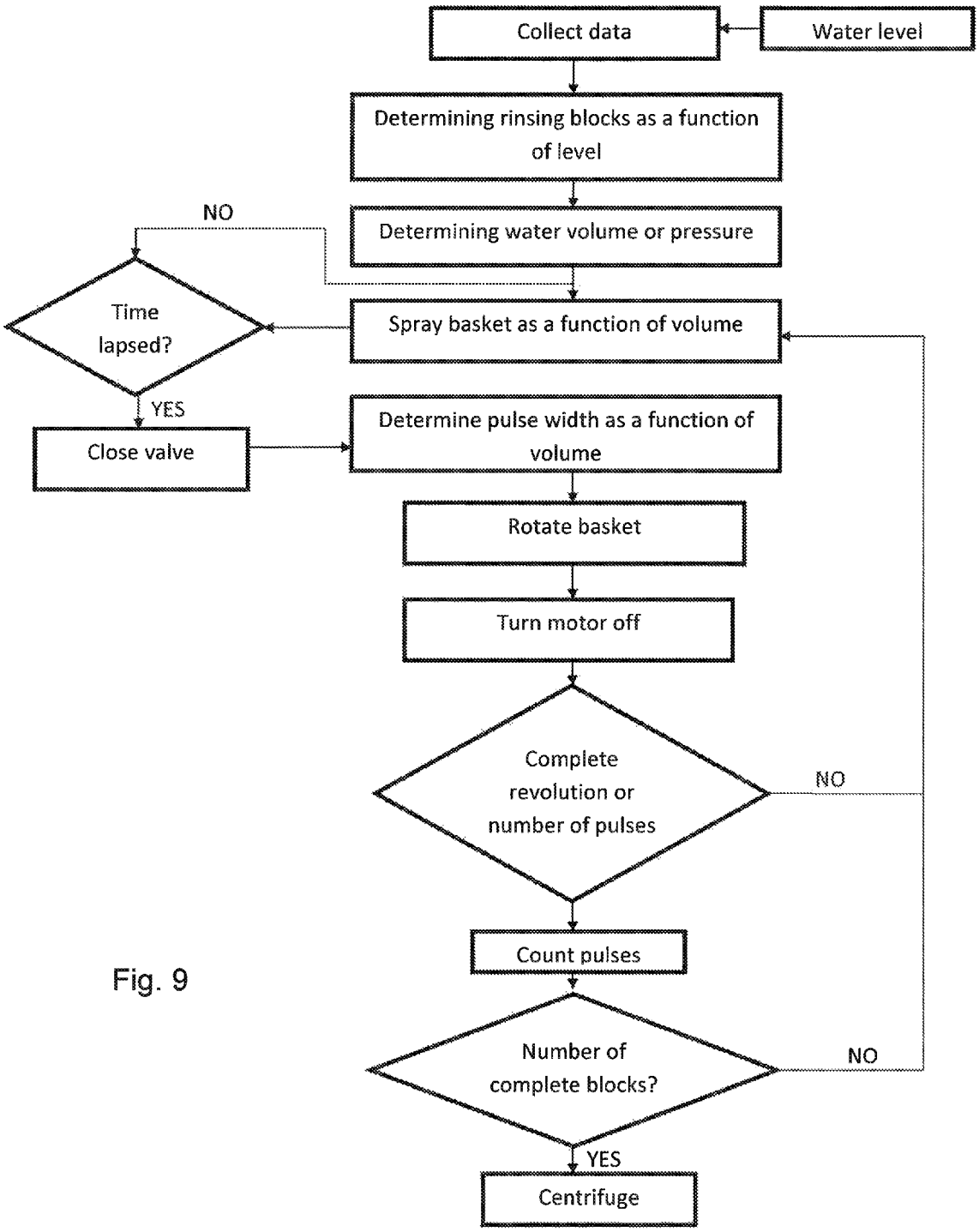
FIG. 9 is a flow diagram of an embodiment of the rinsing cycle.

Rinsing 70—FIG. 9

In the rinsing step, detergent residues, additives or chemicals dissolved in the wash liquor remaining in the objects to be washed are removed, and this can take place in several different ways. Traditionally, the tub 11 is filled with fresh water up to a determined level, to later proceed to agitate by means of the agitator or propeller 13 for a determined period of time, this is then followed by the extraction of wash liquor and the objects to be washed contained in the basket 10 then undergo centrifuge.

The rinsing sequence 70 proposed in present invention does not use a deep rinsing as described in the above lines, but rather, a low amount of water is used, this thanks to the nozzle arrangement 17, 18, 37 which is described below: precisely after the centrifuge or dehydrating step 69, the electronic control 40 collects data such as the water level (maximum, high, medium, low) which was used in the agitation sequence 60, or maximum load agitation sequence in its case; once the electronic control 40 has recovered the data regarding the water level, it proceeds to determine the number of rinsing blocks, according to the following Table 1 obtained from the experimental values which are digitally inserted into the memory of the electronic control 40:

TABLE 1

| Liquid Level in the tub 11 | Number of rinsing blocks |
|---|---|
| Minimum level 51 or level II | 1 to 3 |
| Medium level 52 or level III | 2to 4 |
| High level 53 or level IV | 3 to 5 |
| Maximum level 54 or level V | 3 to 6 |

Each rinsing block comprises a fixed amount of water, which oscillates between 7 liters to 15 liters (that is to say). This amount depends on the particular shape of the tub 11, basket 10, agitator or propeller 13, type of nozzle spray 18 among other engineering parameters. It should also be noted that the number of rinsing blocks is also fixed for a model or given type of washing machine. Also the number of rinsing blocks to be used per each level of liquid is also fixed and determined, the number of rinsing blocks to be used depending somewhat on the amount of objects to be washed, which, in a preferred embodiment was determined in the load determination sequence 65 or according to an alternative embodiment the user by means of knobs indicates the amount of objects to be washed or a specific filling level for the water; the number of rinsing blocks to be used also depends on the shape of the basket 10, among other engineering considerations.

Now then, for a predetermined amount of liquid to be introduced into the rinsing block, which oscillates between 7 liters and 15 liters, as can be for example 10 liters, said water amount has to be sprayed by means of the spray nozzle 18 into the inner part of the basket 10, with the end goal of hydrating the objects to be washed housed within; just as it is necessary to deposit a predetermined amount of water per rinsing block (that is to say, 10 liters) on the objects to be washed, where the pressure or volume found in the supply network is difficult to predict in various countries, the experimental data for the following is digitally inserted into the memory of the electronic control 40; volume, T on of the motor 21, T off of the motor 21. The data is contained in Table 2. So that for a given model or type of washing machine with a given water supply line pressure (for example 3 PSI) corresponds to a determined volume in l/min (for example 3.39 l/min) which were measured at the exit of the nozzle 18. For said pressure and volume, given the nozzle 18, produce a fan angle α particularly (for example 85.02°), which in a preferred embodiment allows us to determine the rotation angle of the basket θ which causes the basket 11 to turn in order to ensure adequate hydration for the objects to be washed introduced into it, knowing that in order to hydrate the objects to be washed they have to lie for a determined amount of time under the liquid fan or waterfall which springs from the nozzle 18. So that for the low pressure or volume values, the aperture angle α is lower than that registered for high pressure and high volume values, so that in a preferred embodiment the rotation angle of the basket θ depends on the referred to aperture angle of the fan α, this with the goal of not allowing areas over the objects to be washed which are not sprayed with liquid, which in practical terms, the referred to rotation angle of the basket θ can be translated into a pulse width T on of the motor 21 (time turned on) with a T off of the motor (resting time or turned off time), with which a pulse train can be generated, which will cause the basket to rotate at a determined θ angle.

The correlation between the referred to θ rotation angle of the basket and the pulse width (T on of the motor 21) depends on the type of motor 21 coupling to the basket 10, to the relationship which the pulleys have, to the gear box (in its case), transmission (in its case), and remaining elements or energy transmission links which are found in the referred to motor 21 and basket 10. The data shown in Table 2 was obtained experimentally for a washing machine design such as the one shown in FIGS. 1, 6*a*, 6*b* already widely described in the above lines. Thus, a determined pressure or volume is assigned to a pulse width (T on of the motor 21) determined (for example approximately 700 milliseconds) to more than one resting time (T off of the motor 21) in which the motor 21 is de-energized (for example approximately 70 milliseconds).

TABLE 2

| Liquid Pressure at the intake (PSI) | Volume (l/min) | Fan Aperture Angle A | T on of the motor 21 in milliseconds | T off of the motor 21 in milliseconds |
|---|---|---|---|---|
| 3 | 3.39 | 85.02° | 687-800 | 60-100 |
| 10 | 4.54 | 97.01° | 687-800 | 60-100 |
| 20 | 6.6 | 114.53° | 750-908 | 80-120 |

TABLE 2-continued

| Liquid Pressure at the intake (PSI) | Volume (l/min) | Fan Aperture Angle A | T on of the motor 21 in milliseconds | T off of the motor 21 in milliseconds |
|---|---|---|---|---|
| 40 | 9.83 | 114.53° | 750-908 | 80-120 |
| 60 | 10.52 | 114.53° | 750-908 | 80-120 |
| 80 | 10.71 | 114.53° | 750-908 | 80-120 |
| 100 | 10.71 | 114.53° | 750-908 | 80-120 |
| 120 | 10.71 | 114.53° | 750-908 | 80-120 |

For a preferred embodiment, the rotation angle of the basket θ is constant for any pressure or volume value, so that the electronic control 40 does not require programming of the above described table; knowing that the T on values of the motor 21 just like the T off values of the motor 21 of the pulse train which the electronic control 40 sends to the driver of the motor 21 so that this causes the basket 10 to rotate at an angle θ are constant, for example T on of the motor 21=700 milliseconds by T off of the motor 21=70 milliseconds.

Now then, as can be surmised from Table 2 it is obvious that at a low pressure value in the supply network, corresponds to a low volume value, in this way the nozzle system 18, 37 can operate with low pressure values in the supply line, as low as 3 PSI, which in an approximate manner represents having a water tank at a height of 2.2 m measured from the water intake of the washer up to the base of the water tank. The referred to nozzle system 18, 37 is also capable of withstanding high liquid pressures emanating from the supply network, where its maximum value is 120 PSI, guaranteeing in this type of pressure range, from 3 PSI to 120 PSI, an efficient spraying over the objects to be washed (at this point it would be better stated as to be rinsed).

The nozzle 18 guarantees that the fan will open at an α angle whose value varies between 85° to 114° according to Table 2 (see FIGS. 4*b*, 6*a*, 6*b*).

As can also be surmised from the referred to Table 2, the low α values correspond to low water pressures emanating from the network. Now then, retaking the rinsing sequence 70, the electronic control 40 sends a pulse to the driver of the motor 21, which allows the motor 21 to become energized and turn in one direction for the period of time which one pulse width lasts. The time which the referred to pulse lasts for is stipulated by T on of the motor 21, when the duration of the pulse has lapsed, the electronic control 40 counts one T off of the motor 21, during which the pulse towards the driver of the motor 21 is interrupted. This pulse train lasts at least for one revolution of the basket 10.

In an alternative embodiment of the present invention, a hall type position sensor or detector can be used. Upon using the referred to position detector, the electronic control 40 sends a pulse to the driver of the motor 21, reports a determined number of pulses to the electronic control 40 each time the motor 21 is activated in any direction; in this manner the number of pulses emitted by the rotor position detector in order to achieve a determined θ angle can be counted. The correlation between the referred to θ angle and the number of pulses which the rotor position detector requires be counted, can be obtained experimentally, knowing that this will depend on the type of sensor to be used, the sensitivity, precision, among other characteristics, as well as the relationship between the pulleys, the use of the transmission as well as the relationship thereof, the diameter of the basket 10, among other design and engineering considerations and peculiarities. Now then, once the electronic control 40 has counted the desired number of pulses for a θ angle, the electronic control 40 stops the pulse towards the driver of the motor 21, which causes the basket 10 to eventually stop itself. In a simultaneous manner, the electronic control 40 sends a pulse to the driver of the filling valve which causes the filling valve 45 to become energized allowing the flow of liquid towards the nozzle 18. The referred to pulse which the electronic control 40 emits towards the driver of the filling valve 78, has a predetermined duration, said duration or pulse width in a preferred embodiment of the invention has a duration equal to that required to pour a predetermined amount of liquid to be introduced into the rinsing blocks towards the objects to be rinsed, which oscillates between 7 liters and 15 liters, as could be for example approximately 10 liters, each amount of water sprayed by means of the spray nozzle 18 towards the inner part of the basket 10, therefore, thanks to the experimental pressure and volume data contained in Table 2 so that the time which the valve 45 remains open can be determined. In an alternative embodiment the spraying through the nozzle 18 is undertaken in an intermittent manner, energizing and de-energizing the valve 45 as many times as necessary until the predetermined amount of liquid to be introduced by the rinsing block is poured unto the objects to be rinsed, which oscillates between 7 liters and 15 liters, as could be for example approximately 10 liters. Therefore, the approximately 10 liters of our example can be poured through the nozzle 18 in regular intervals being able to coincide the width of the pulse sent by the electronic control 40 towards the driver which will energize the valve 45, with the width of the pulse which the electronic control 40 also sends the driver of the motor 20 which makes the basket 10 rotate at an θ angle. In another embodiment another configuration or relationship between the referred to pulse widths could be used.

Once the predetermined amount of liquid to be introduced by the rinsing block has been poured unto the objects to be rinsed which oscillates between 7 liters and 15 liters, as could be for example approximately 10 liters, the electronic control 40 interrupts the pulse or pulse train towards the driver of the filling valve 45, thereby de-energizing the filling valve 45, thus ceasing the water or liquid flow through the nozzle 18. These steps are repeated until the number of predetermined rinsing blocks according to Table 1 have been carried out, keeping in mind that the number of these depends in a preferred embodiment on the amount detected of objects to be washed.

Once the number of predetermined rinsing blocks has been carried out, the electronic control 40 proceeds to centrifuge the basket 10, using the previously described dehydrating sequence 69.

Having broadly described the invention under comment, it is deemed as having a high degree of inventive activity, its industrial application being undeniable, cautioning at the same time that an expert in the field with knowledge in the area would be able to perceive alternative embodiments; that is to say; the using of a constant velocity in the basket upon rotating it to receive water emanating from the spray nozzle 18 while this allows the predetermined amount of passage of water of the rinsing block, this being said an expert in the field would be able to find various embodiments which do not depart from the scope of the present invention described and claimed.

The invention claimed is:

1. A method for washing using a vertical washing machine comprising a tub in which a basket is housed which rotates concentrically within the tub, an agitator or propeller, the agitator or propeller and the basket being driven by a motor and coupled by a clutch, a pressure switch, filling valves, a spray system, and an electronic control with a memory, the method for washing comprising:

a) checking the water level within the tub by means of the pressure switch to determine if said water level is greater than a predetermined level I;

b) sensing that the water level is greater than level I, the pressure switch sends a signal to the electronic control to begin a load determination sequence to indicate a measurement level corresponding to the water level required for washing the objects introduced into the basket;

c) after said load determination sequence, comparing by means of the electronic control the water level within the tub reported by the pressure switch versus the water level required by an agitation sequence considering the volume of the objects to be washed introduced into the basket;

d) carrying out a volume determination sequence by sending a signal to the filling valves to allow a flow of water towards the tub to avoid wetting the objects to be washed contained in the basket, counting by means of a timer a filling time between the level I until the measurement level required by the agitation sequence, wherein once the measurement level has been reached, the pressure switch sends a signal to the electronic control to stop the timer, registering the filling time and closing the filling valves;

e) performing the agitation sequence comprising a pattern of slaps or arcs and strokes per minute for a determined time;

f) at the end of the agitation sequence, performing a centrifuge or dehydrating sequence to remove wash liquor contained in the tub and extracting wash liquid or liquor contained in the textiles or objects introduced into the basket;

g) carrying out a rinsing sequence, wherein the electronic control recovers data related to the water level used in the agitation sequence or maximum load agitation sequence to determine the number of rinsing blocks and energizes the filling valve, each rinsing block comprising a fixed amount of water, which is sprayed at an angle α oscillating between 85° to 114° into the inner part of the basket by energizing a nozzle from the spraying system to hydrate the objects within the tub, wherein the nozzle is able to spray water at both low and high pressures emanating from the supply network oscillating from 3 PSI to 120 PSI, determining a pulse width in order to rotate the basket at an angle θ to ensure adequate hydration for the objects to be washed, wherein the spraying through the nozzle is performed in an intermittent manner, h) de-energizing the filling valve to stop water or liquid flow through the nozzle and repeating steps a) to g) until the number of predetermined rinsing blocks have been carried out; and i) centrifuging the basket using the dehydrating sequence of step f.

2. The method according to claim 1, wherein the method additionally comprises carrying out a pre-detection sequence, sending at least one pulse to the motor to achieve a determined arc length in one first direction, measuring the time it takes the basket to reach the determined arc length as a function of the pulse of the motor, counting and storing in the memory the pulses starting from the de-energized motor to achieve the arc length, sending at least one pulse to the motor to achieve a determined arc length in a second direction, measuring the time it takes the basket to reach the determined arc length in the second direction as a function of the pulse of the motor, counting and storing in the memory the pulses starting from the de-energized motor to achieve the arc length in the second direction and compare the counted pulses in comparison to the pre-determined pulses.

3. The method according to claim 2, wherein if the pulses counted are greater than or equal to the pre-determined pulses, a clothes re-shuffling sequence is carried out, in which the flow of water is permitted, the spray system is activated, the basket and the agitator or propeller are rotated, and the rotation velocity is determined.

4. The method according to claim 1, wherein if during the load determination sequence of subparagraph b) is determined that no overload exists, the flow of water is permitted, the water level is determined closing the flow if a predetermined level has been reached, the basket, the agitator or the propeller are agitated, the arcs and the slaps are measured in two different times, the pulses are counted, the pulses are averaged with some previous pulses, the average obtained is compared against the predetermined values and it is determined if more water will enter.

5. The method according to claim 1, wherein if during the load determination sequence of subparagraph b) is determined that an overload does exist, it proceeds to the maximum load agitation function.

6. The method according to claim 1, wherein the nozzle from the spray system is coupled in fluid connection to a hose and wherein the hose is in fluid connection with an admission valve.

7. The method according to claim 6, wherein the spray nozzle comprises at least three sections:

a) a back section with a circular duct section with an inner surface and an outer surface, wherein the outer surface comprises a ringlet which functions as a bump and a retainer or seal of a hose;

b) an intermediary section with a frustoconical shape which gradually reduces a cross section of the duct, the intermediary section causes the fluid which circulates within it to gain speed upon the cross section being reduced and the flow being kept uniform; and c) a head comprising a mouthpiece which is a cavity which receives the flow of fluid emanating from the intermediate section, the referred to mouthpiece cavity is delimited by a pair of lateral walls set at a $\delta$ angle, and wherein the mouthpiece is delimited by a deflector wall set in front of the exit of the intermediary section, and a back wall, both configured in such a way that the flow of fluid emanating from the intermediary section collides against the deflector wall, allowing the mouthpiece cavity be filled with fluid in its entirety, producing a fan of fluid with an opening angle $\alpha$ with an inclination angle $\beta$, allowing the basket to be sprayed.

8. The method according to claim 7, wherein said spray nozzle comprises an integral or separate support.

9. The method according to claim 1, wherein the pressure oscillates between 3 PSI up to 20 PSI.

10. The method according to claim 1, wherein the fixed amount in the rinsing blocks of subparagraph g) oscillates between 7 liters to 15 liters.

11. The method according to claim 1, wherein the rotation angle of the basket $\theta$ is constant for any supply network pressure or water volume.

12. The method according to claim 1, wherein the rotation angle of the basket $\theta$ depends on the supply network pressure or water volume.

13. The method according to claim 1, wherein the intermittent step in subparagraph g) involves energizing and de-energizing the valve as many times as necessary until the predetermined amount of liquid to be introduced by the rinsing block is poured unto the objects to be rinsed.

14. The method according to claim 1, wherein if during the checking of subparagraph a) is determined that water level contained in the tub is lesser than that required to carry out the agitation sequence, the electronic control undertakes the volume determination sequence, by introducing the liquid into the tub in order to reach the liquid level required to carry out the agitation sequence, next the electronic control undertakes the volume determination sequence by introducing liquid into the tub to reach the liquid level required to performing the agitation sequence.

15. The method according to claim 1, wherein the predetermined time in subparagraph e) is from about 5 to about 30 minutes.

16. The method according to claim 1, wherein during the agitation sequence of subparagraph e) the arc oscillates between about 180 to about 720 degrees obtaining from 30 to 60 strokes per minute to allow a correct friction between the scrubbers of the agitator and the objects to be washed and also contributes to a better dispersion of the objects to be washed within the basket, achieving that these may have adequate movement of the clothing.

* * * * *